US005398438A

United States Patent [19]

Williams

[11] Patent Number: 5,398,438

[45] Date of Patent: Mar. 21, 1995

[54] FIREARM SAFETY DEVICE FOR PREVENTING THE DISCHARGE OF THE FIREARM

[75] Inventor: E. J. Williams, Oklahoma City, Okla.

[73] Assignee: M & W Technologies, Inc., Oklahoma City, Okla.

[21] Appl. No.: 121,625

[22] Filed: Sep. 14, 1993

[51] Int. Cl.[6] ..... F41A 17/02; F41A 17/04; F41A 17/44

[52] U.S. Cl. ..... 42/70.11

[58] Field of Search ..... 42/70.11, 66

[56] References Cited

U.S. PATENT DOCUMENTS

| | | | |
|---|---|---|---|
| 3,678,609 | 7/1972 | Fazio | 42/96 |
| 3,813,802 | 6/1974 | DiProspero | 42/96 |
| 4,010,565 | 3/1977 | DiProspero | 42/96 |
| 4,266,356 | 5/1981 | Järvinen | 42/70.11 |
| 4,398,366 | 8/1983 | Wernicki | 42/70.11 |
| 4,462,179 | 7/1984 | Rogak et al. | 42/70.01 |
| 4,512,099 | 4/1985 | Mathew | 42/70.11 |
| 4,783,924 | 11/1988 | Thurber | 42/70.11 |
| 4,969,284 | 11/1990 | Healey | 42/70.11 |
| 5,016,377 | 5/1991 | Gunning | 42/70.11 |
| 5,044,106 | 9/1991 | Slocum | 42/70.11 |
| 5,048,211 | 9/1991 | Hepp | 42/70.11 |
| 5,052,142 | 10/1991 | Mikus | 42/70.11 |
| 5,054,223 | 10/1991 | Lee | 42/70.11 |
| 5,062,233 | 11/1991 | Brown | 42/70.11 |
| 5,070,635 | 12/1991 | Cvetanovich | 42/70.11 |
| 5,115,589 | 8/1992 | Shuker | 42/70.11 |
| 5,138,785 | 5/1992 | Paterson | 42/70.11 |
| 5,171,924 | 12/1992 | Honey et al. | 42/70.11 |
| 5,239,767 | 8/1993 | Briley et al. | 42/70.11 |
| 5,241,770 | 9/1993 | Lambert | 42/70.11 |
| 5,289,653 | 3/1994 | Szebeni et al. | 42/70.11 |

*Primary Examiner*—David Brown
*Attorney, Agent, or Firm*—Dunlap & Codding

[57] ABSTRACT

A firearm safety device including a tube assembly which is insertable through the barrel and/or and through a portion of the cartridge chamber. A stop assembly is disposed in the tube assembly. The stop assembly has a locking position and an unlocking position. In the locking position, a portion of the stop assembly extends a distance from an outer peripheral surface of the tube assembly for engaging a portion of the firearm and preventing removal of the tube assembly from the barrel and the cartridge chamber. A plunger is disposed in the tube assembly. One end of the plunger is engageable with the stop assembly for moving the stop assembly to the unlocked position. A blocking device is disposed in the tube assembly for preventing the plunger from engaging the stop assembly and moving the stop assembly to the unlocked position. In one form, the safety device includes a combination lock assembly for removing the blocking device from the plunger and permitting the plunger to engage the stop assembly for moving the stop assembly to the locking position.

44 Claims, 7 Drawing Sheets

FIREARM SAFETY DEVICE FOR PREVENTING THE DISCHARGE OF THE FIREARM

FIELD OF THE INVENTION

The present invention relates generally to safety devices for firearms and, more particularly, but not by way of limitation, to a safety device for a firearm which includes a portion which extends through the barrel bore and/or cartridge chamber of the firearm and is locked in that position in a locked position of the safety device. In one aspect, the safety device includes a combination lock which permits the safety device to be removed from the barrel bore and cartridge chamber in the unlocked position of the combination lock.

BRIEF DESCRIPTION OF THE DRAWINGS

FIG. 4 is a sectional view of the firearm safety device of FIGS. 1 and 3 showing the firearm safety device in a locking position.

DESCRIPTION OF THE PREFERRED EMBODIMENTS

Figure 1:
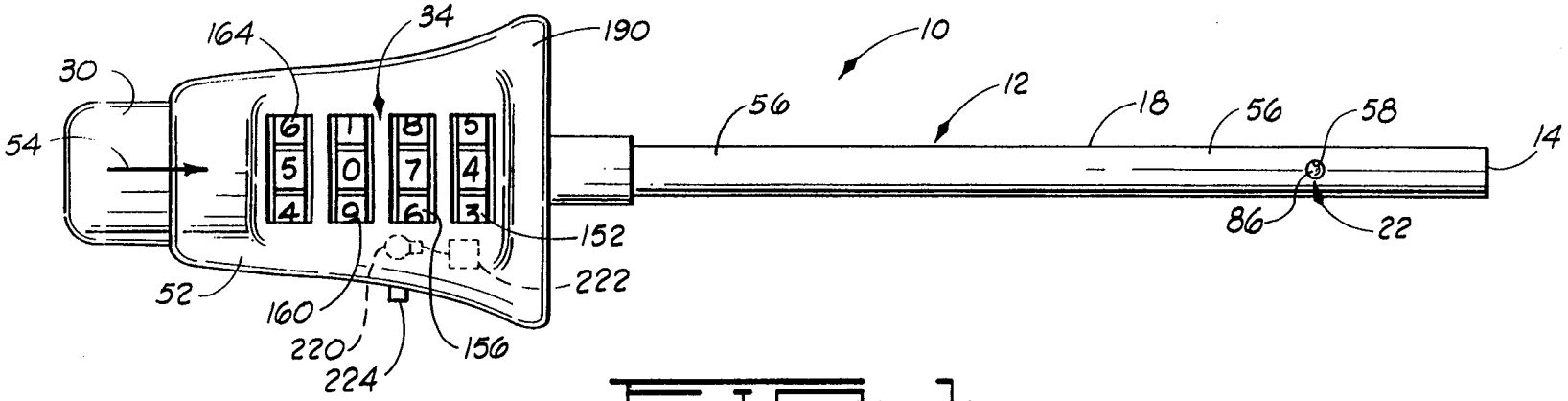
FIG. 1 is an elevational view of a firearm safety device constructed in accordance with the present invention.
Figure 5:
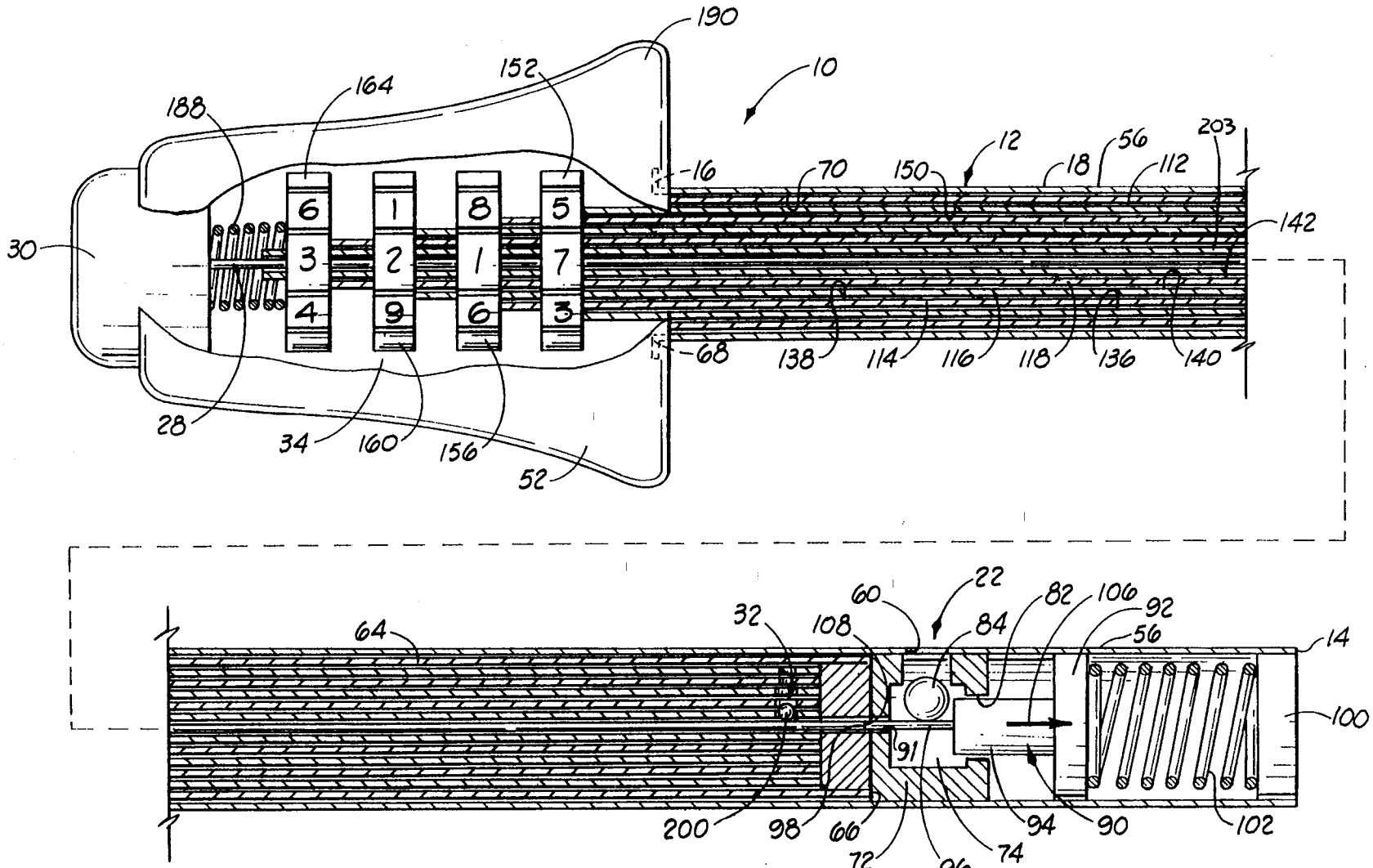
FIG. 5 is a sectional view, similar to FIG. 4, but showing the firearm safety device in an unlocked position.

Referring to the drawings in general and to FIG. 1 in particular, shown therein and designated by the general reference numeral 10 is a firearm safety device constructed in accordance with the present invention. In general, the firearm safety device 10 includes a tube assembly 12 having a first end 14 (FIGS. 1, 2, 3, 4 and 5) and a second end 16 (FIGS. 3, 4 and 5). The tube assembly 12 has an outer peripheral surface 18 (FIGS. 1, 2, 3, 4 and 5) which defines an outside diameter 20 (FIG. 4) of the tube assembly 12.

Figure 7:
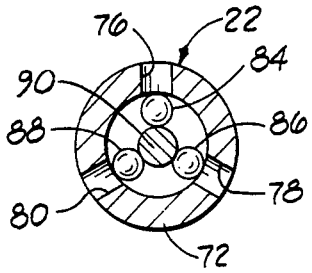
FIG. 7 is a sectional view, partial elevational view showing the stop housing with the stop members disposed therein and with the pin positioned so that the stop members are in the unlocked position.

The firearm safety device 10 also includes a stop assembly 22 (FIGS. 1, 2, 4, 5 and 7) having a locking position (FIGS. 2 and 4) and an unlocking position (FIGS. 1, 5 and 7). In the locking position, a portion of the stop assembly 22 extends a distance from the outer peripheral surface 18 of the tube assembly 12 for engaging a portion of a firearm (an example firearm being shown in FIG. 2 and designated therein by the general reference numeral 26) and preventing the removal of the tube assembly 12 from the firearm 26. In the unlocking position of the stop assembly 22, the firearm safety device 10 is disengaged from the firearm 26 and is removable from the firearm 26 so that the firearm 26 can be operated in a normal manner.

The firearm safety device 10 also includes a plunger 28 (FIGS. 3, 4, 5 and 13) which is connected to a plunger cap 30 (FIGS. 1, 2, 3, 4 and 5). The plunger 28 is engageable with the stop assembly 22 for moving the stop assembly 22 to the unlocking position to permit removal of the firearm safety device 10 from the firearm 26 in one condition of the firearm safety device 10, as will be made more apparent below.

A blocking assembly 32 (FIGS. 4, 5 and 13) is interposed between the plunger 28 and the stop assembly 22 in one condition of the firearm safety device 10 for preventing the stop assembly from being moved to the unlocking position. In one other condition in the firearm safety device 10, the blocking assembly 32 is removed from between the plunger 28 and the stop assembly 22 for permitting the plunger 28 to engage the stop assembly 22 for permitting the stop assembly 22 to be moved to the unlocking position thereby permitting removal of the firearm safety device 10 from the firearm 26.

The firearm safety device 10 also includes a lock assembly 34 (FIGS. 1, 2, 4 and 5) which is connected to the blocking assembly 32. The lock assembly 34 has a locked position and an unlocked position. In the locked position, the lock assembly 34 prevents the blocking assembly 32 from being removed from between the plunger 28 and the stop assembly 22. In the unlocked position of a lock assembly 34, the blocking assembly 32 is permitted to be removed from between the plunger 28 and the stop assembly 22 thereby permitting the stop assembly 22 to be moved to the unlocking position.

Figure 2:
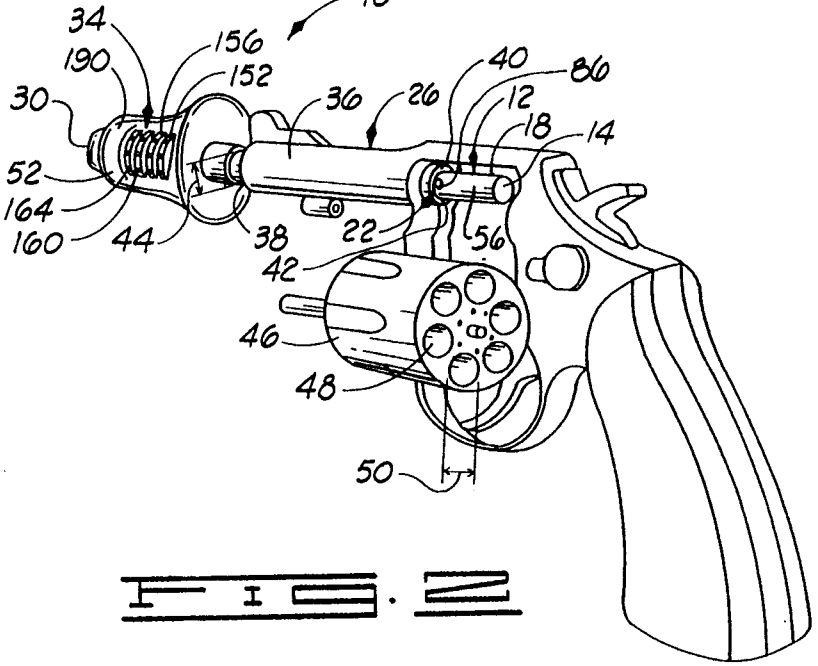
FIG. 2 is a perspective view showing the firearm safety device of FIG. 1 disposed through a barrel bore of a firearm and showing the cylinder of the firearm in a non-operating position.
Figure 3:
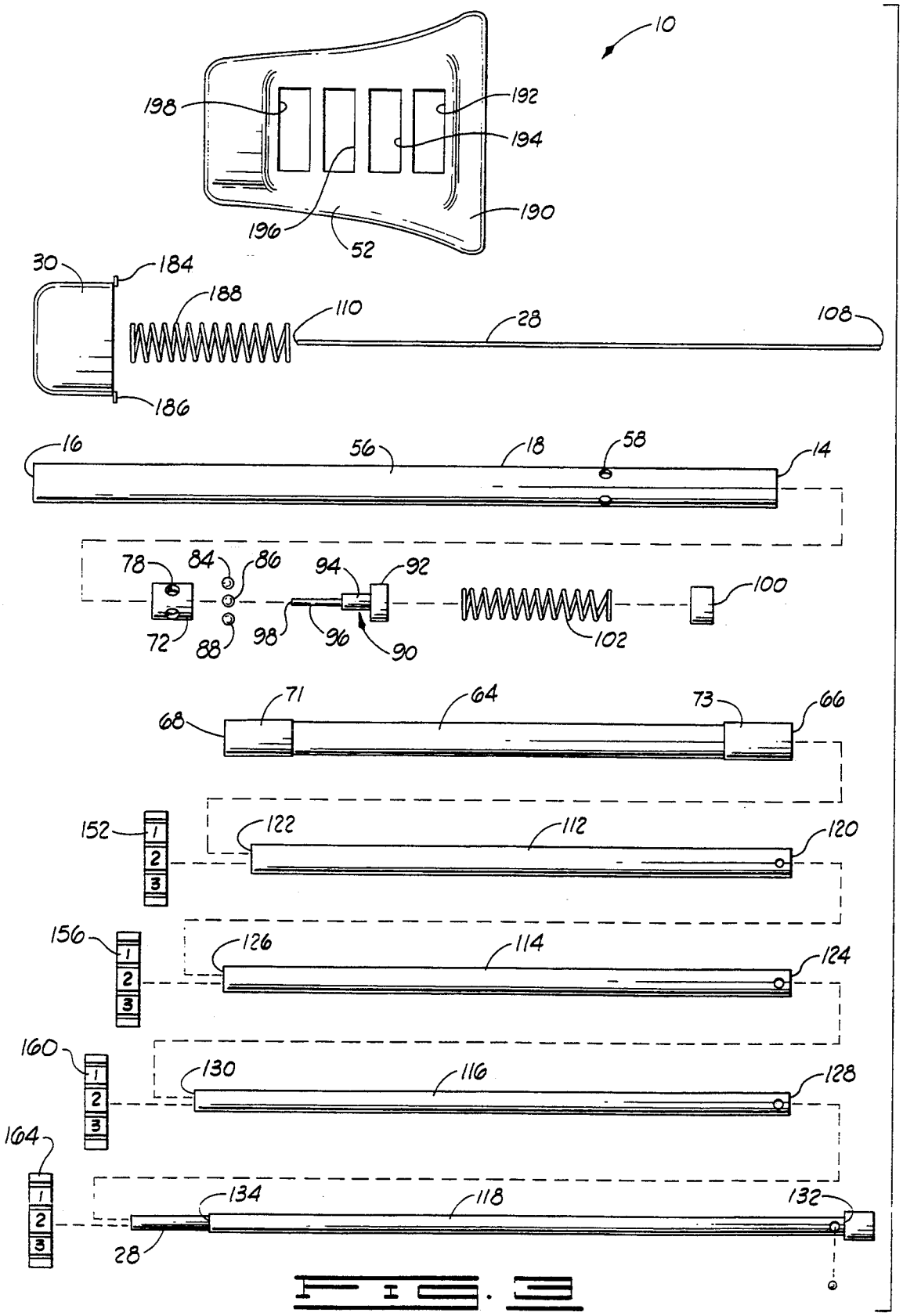
FIG. 3 is an exploded view showing the components of the firearm safety device of FIG. 1 in an unassembled position, the dashed lines shown in FIG. 3 indicating the assembly of the components shown in FIG. 3.
Figure 3:
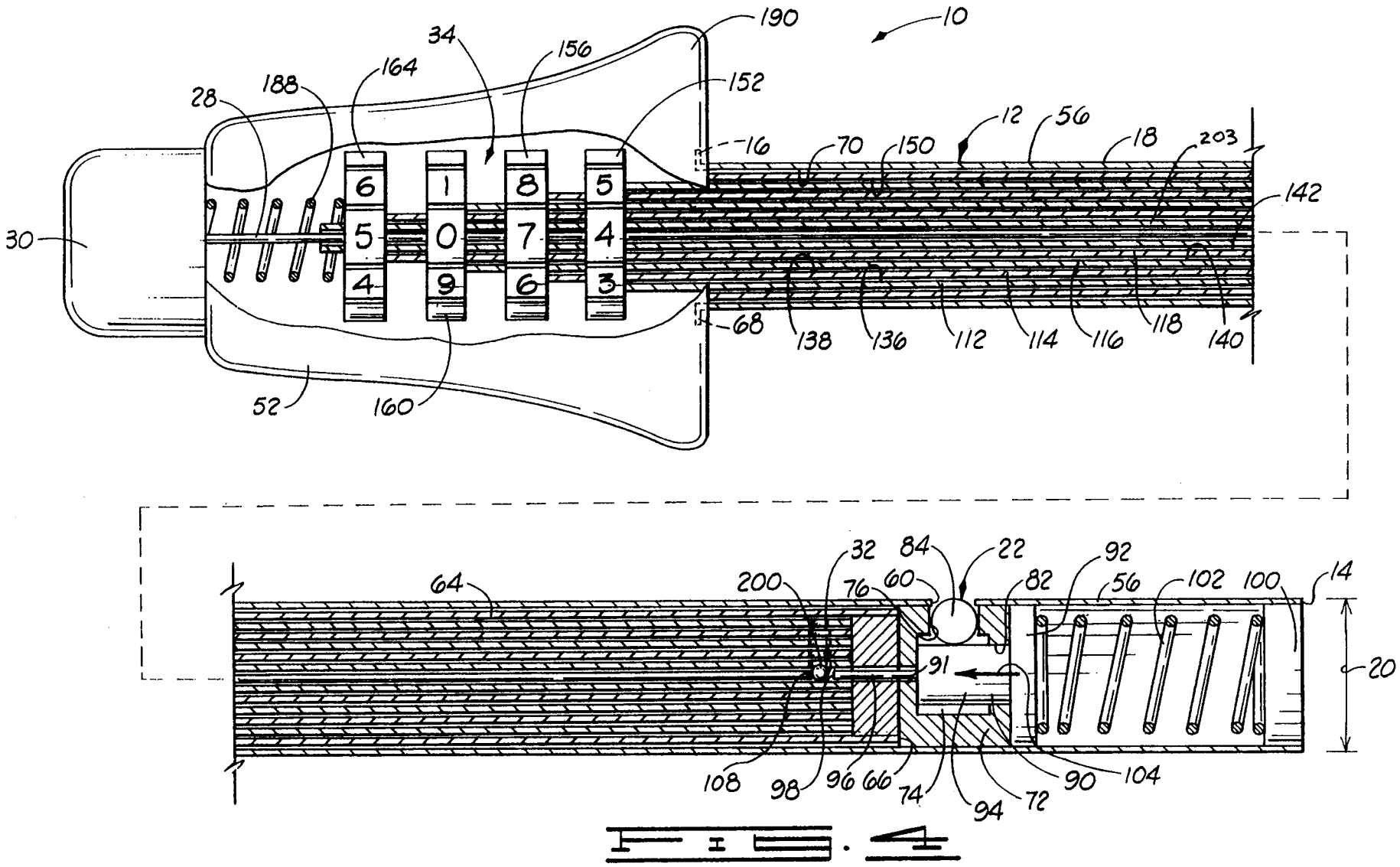
Figure 15:
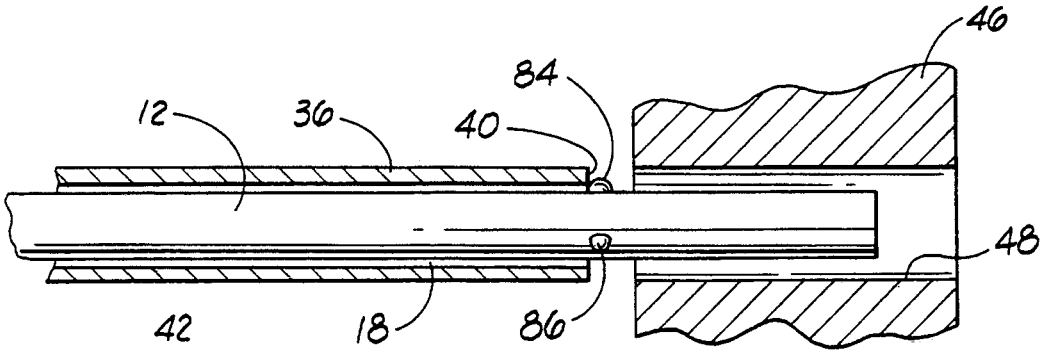
FIG. 15 is an enlarged view showing a portion of the barrel and a portion of the cylinder with the tube assembly positioned in the barrel and cylinder in the locking position.

The firearm 10 includes a barrel 36 (FIGS. 2 and 15) having a first end 38 (FIG. 2) and a second end 40 (FIGS. 2 and 15). A barrel bore 42 (FIGS. 2 and 15) extends through the barrel 36 intersecting the first and the second ends 38 and 40. The barrel bore 42 has a bore diameter 44 (FIG. 2). The outside diameter 20 of the tube assembly 12 is less than the bore diameter 42 so that the tube assembly 12 is insertable through the barrel bore 42.

The firearm 26 includes a cylinder 46 (shown in FIG. 2 in a non-operating position and shown in FIG. 15 in an operating position). The cylinder 46 includes a plurality of cartridge chambers 48. Only one of the cartridge chambers 48 is designated with a reference numeral in FIG. 2 for clarity and the firearm 26 shown in FIG. 2 more particularly has 6 cartridge chambers 48 for example. Each cartridge chamber 48 has a chamber diameter 50 (shown in FIG. 2 with respect to one of the cartridge chambers 48). The chamber diameters 50 each are greater than the outside diameter 20 of the tube assembly 12 so that a portion of the tube assembly 12 is insertable through one of the cartridge chambers 48 in a locking position of the firearm safety device 10.

When the cylinder 46 is moved to the operating position, one of the cartridge chambers 48 is aligned with the barrel bore 42 so that a cartridge disposed therein can be fired through the barrel bore 42 in a manner well known in the art.

In general, an individual first moves the lock assembly 34 to the unlocked position. The individual then grips the hand grip 52 (FIGS. 1, 2, 3, 4 and 5) and, with the palm of the individual's hand, the individual pushes the plunger cap 30 in a direction 54 (FIG. 1) thereby moving the plunger 28 into engagement with the stop assembly 22 for permitting the stop assembly 22 to be moved to the unlocking position. In the unlocking position of the stop assembly 22, the tube assembly 12 is inserted through the barrel bore 42 and through the cartridge chamber 48 aligned with the barrel bore 42 (FIG. 15). In this position of the firearm safety device 10, the individual releases the plunger cap 30 thereby releasing the plunger 28 for moving the plunger 28 out of engagement with the stop assembly 22 and causing the stop assembly 22 to be moved to the locking position. In the locking position, the stop assembly 22 engages a portion of the firearm 26 for preventing the removal of the tube assembly 12 from the barrel bore 42 and the cartridge chamber 48.

As a practical matter, the firearm safety device 10 only can be removed from the barrel bore 42 and cartridge chamber 48 by first positioning the lock assembly 34 in the unlocked position and thereby removing the blocking assembly 32 from its position between the plunger 28 and the stop assembly 22. When it is desired to remove the firearm safety device 10 from the firearm 26, the individual first positions the lock assembly 34 in the unlocked position. In the unlocked position of the lock assembly 34, the blocking assembly 32 is removed from its position between the plunger 28 and the stop assembly 22. The individual then grips the hand grip 52 and, with the palm of the individual's hand, the individual moves the plunger cap 30 in the direction 54 thereby causing the plunger 28 to be moved in the direction 54 for engaging the stop assembly 22 and permitting the stop assembly 22 to be moved to the unlocking position. In the unlocking position of the stop assembly 22, the tube assembly 12 may be removed from the barrel bore 42 and the aligned cartridge chamber 48.

The lock assembly 34 as shown in FIGS. 1, 2, 3, 4 and 5, more particularly, is a combination lock assembly. Thus, to remove the firearm safety device 10 from the firearm 26, one must know the particular combination and must manipulate the lock assembly 34 in accordance with the particular combination to move the lock assembly 34 to the unlocked position. If the combination is not known, it virtually is impossible to remove the firearm safety device 10 from the firearm 26. Although it theoretically is possible to manipulate the lock assembly 34 in various positions until one, by chance, determines the right combination, this, as a practical matter, represents an impossibility.

The tube assembly 12 includes an outside tube 56 (FIGS. 1, 2, 3, 4 and 5) which has a first end corresponding to the first end 14 of the tube assembly 12 and a second end corresponding to the second end 16 of the tube assembly 12. The outside tube 56 also has an outer peripheral surface corresponding to the outer peripheral surface 18 of the tube assembly 12 and an outside diameter corresponding to the outside diameter 20 of the tube assembly 12.

Figure 6:
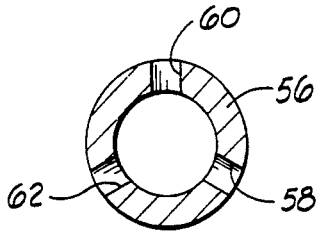
FIG. 6 is a sectional view of the outside tube taken along lines showing the stop openings formed through the sectional tube.

Three stop openings 58 (FIGS. 1, 3 and 6), 60 (FIGS. 4, 5 and 6) and 62 (FIG. 6) are formed through the outside tube 56. The stop openings 58, 60 and 62 are spaced circumferentially about the outside tube 56. The stop openings 58, 60 and 62 each are spaced about 120° apart. The stop openings 58, 60 and 62 each are positioned on the outside tube 56 at a position spaced a distance from the first end 14 of the tube assembly 12.

The tube assembly 12 also includes an inside tube 64 (FIGS. 3, 4 and 5). The inside tube 64 is a spacer which is utilized to fit the tube assembly 12 within the bore of the firearm. On smaller caliber firearms, the spacer tube 64 may be eliminated. By the same token, on larger caliber firearms, more spacer tubes may be utilized.

The inside tube 64 has a first end 66 (FIGS. 3, 4 and 5) and a second end 68 (FIGS. 3, 4 and 5). The outside tube 56 has an opening 70 (FIGS. 4 and 5) which extends therethrough and intersects the first and the second ends 14 and 16 thereof. The inside tube 64 is positioned in the opening 70 of the outside tube 56. The first end 66 of the inside tube 64 is spaced a distance from the first end 14 of the outside tube 56, as shown more clearly in FIGS. 4 and 5. The second end 68 of the inside tube 64 is aligned with the second end 16 of the outside tube 56, as shown more clearly in FIGS. 4 and 5.

Although a space is shown between the outer peripheral surface of the inside tube 64 and the inner peripheral surface of the outside tube 56 in FIGS. 4 and 5, preferably there is an interference fit between the outside tube 56 and the inside tube 64 so that the inside tube 64 is not rotatable within the outside tube 56. As shown in FIG. 3, spacers 71 and 73 (FIG. 3) are provided on the ends of the inside tube 64 for providing the interference fit with the outside tube 56.

The stop assembly 22 includes a stop housing 72 (FIGS. 3, 4, 5 and 7) having a stop chamber 74 (FIGS. 4 and 5) formed therein. Three stop openings 76, 78 and 80 (FIG. 7) are formed through the stop housing 72. Each of the stop openings 76, 78 and 80 intersects and is in communication with the stop chamber 74. A pin opening 82 (FIGS. 4 and 5) is formed through the stop housing 72. The pin opening 82 intersects and is in communication with the stop chamber 74. Three spherically shaped stop members 84 (FIGS. 3, 4, 5 and 7), 86 (FIGS. 1, 2, 3 and 7) and 88 (FIG. 7) are disposed in the stop chamber 74. A rod opening 91 (FIGS. 4 and 5) is formed through one end of the stop housing 72.

Each of the stop members 84, 86 and 88 has a diameter which is slightly less than the diameter of the stop openings 76, 78 and 80 so that the stop members 84, 86 and 88 may freely move through the stop opening 76, 78 or 80 aligned therewith. The stop member 84 is positioned in the stop chamber 74 in alignment with the stop opening 76, the stop member 86 is positioned in the stop chamber 74 in alignment with the stop openings 78 and the stop member 88 is positioned in the stop chamber 74 in alignment with the stop opening 78, as shown in FIG. 7. Further, the diameter of each of the stop openings 58, 60 and 62 formed through the outside tube 56 is less than the diameter of the stop members 84, 86 and 88 so that only a portion of the stop members 84, 86 and 88 is extendible through the aligned stop opening 58, 60 or 62 in the outside tube 56, for reasons to be made more apparent below. The stop members 84, 86 and 88 preferably are spherically shaped ball bearings.

It should be noted that only one or two stop members could be included in a particular embodiment with cooperating one or two stop openings. By the same token, more than three stop members could be utilized.

The stop assembly 22 also includes a pin 90 (FIGS. 3, 4 and 5). The pin 90 includes a pin head 92 (FIGS. 3, 4 and 5). The pin 90 includes an enlarged diameter portion 94 (FIGS. 3, 4 and 5) which is connected to the pin head 92 and extends a distance therefrom. The pin 90 also includes a reduced diameter portion 96 (FIGS. 3, 4 and 5) which is connected to the enlarge diameter portion 94 and extends a distance therefrom terminating with a pin end 98 (FIGS. 3, 4 and 5).

The stop housing 72 is disposed in the opening 70 in the outside tube 56 and positioned therein so that the stop opening 76 is aligned with the stop opening 60, the stop opening 78 is aligned with the stop opening 58 and the stop opening 80 is aligned with the stop opening 62. The pin 90 is disposed through the pin opening 82 in the stop housing 72. More particularly, the enlarged diameter portion 94 of the pin 90 is disposed in the pin opening 82 with the pin 90 being positioned in the stop housing 72 so that the pin head 92 is engageable with a portion of the stop housing 72 in one position of the pin 90 and the reduced diameter position 96 extends through the rod opening 91.

In the locking position of the stop assembly 22, the enlarged diameter portion 94 of the pin 90 extends through the stop housing 72 and engages the stop members 84, 86 and 88 forcing the stop members 84, 86 and 88 radially outwardly through the respective stop openings 76, 78 and 80 to a position wherein a portion of each of the stop members 84, 86 and 88 extends a distance outwardly through the respective stop openings 58, 60 and 62 thereby extending a distance radially outwardly from the outer peripheral surface 18 of the outside tube 56. In the unlocking position of the stop assembly 22, the reduced diameter portion 96 of the pin 90 is positioned in the stop housing 72 thereby permitting each of the stop members 84, 86 and 88 to fall and drop into the stop housing 72 thereby removing the stop members 84, 86 and 88 from the respective stop openings 58, 60 and 62.

An end cap 100 (FIGS. 3, 4 and 5) is disposed in the opening 70 in the outside tube 56 and secured therein. The end cap 100 is positioned about adjacent the first end 14 of the outside tube 56.

A spring 102 (FIGS. 3, 4 and 5) is disposed in the opening 70 in the outside tube 56. One end of the spring 102 engages the end cap 100 and the opposite end of the spring 102 engages the pin head 92. The spring 102 biasingly forces the pin 90 in a direction 104 (FIG. 4) for biasingly moving the enlarged diameter portion 94 of the pin 90 into the stop chamber 74 and forcing the stop members 84, 86 and 88 through the respective stop openings 58, 60 and 62. The pin 90 also is movable in a direction 106 (FIG. 5) for moving the reduced diameter portion 96 of the pin 90 into the stop chamber 74 thereby permitting the stop members 84, 86 and 88 to drop or fall within the stop chamber 74 and out of the respective stop openings 58, 60 and 62.

The plunger 28 has a first end 108 (FIGS. 3, 4 and 5) and a second end 110 (FIG. 3). The plunger 28 is aligned with the reduced diameter portion 96 of the pin 90 and, more particularly, with the pin end 98 of the pin 90.

The plunger 28 is movable in the direction 106 to a position wherein the first end 108 of the plunger 28 engages the pin end 98 of the pin 90 for moving the pin 90 in the direction 106 in an unblocking position of the blocking assembly 32 and in an unlocked position of the lock assembly 34. In the blocking position of the blocking assembly 32, the blocking assembly 32 is disposed between the first end 108 of the plunger 28 and the pin end 98 of the pin 90 for preventing the plunger 28 from engaging the pin 90 and moving the pin 90 in the direction 106 against the biasing force of the spring 102, for reasons to be made more apparent below.

The lock assembly 34 includes four lock tubes, a first lock tube 112 (FIGS. 3, 4 and 5) a second lock tube 114 (FIGS. 3, 4 and 5), a third lock tube 116 (FIGS. 3, 4 and 5) and a fourth lock tube 118 (FIGS. 3, 4 and 5). The first lock tube 112 has a first end 120 (FIG. 3) and a second end 122 (FIG. 3). The second lock tube 114 has a first end 124 (FIG. 3) and a second end 126 (FIG. 3). The third lock tube 116 has a first end 128 (FIG. 3) and a second end 130 (FIG. 3). The fourth lock tube 118 has a first end 132 (FIG. 3) and a second end 134 (FIG. 3). Each of the lock tubes 112, 114, 116 and 118 are cylindrically shaped.

The first lock tube 112 has a lock tube opening 136 (FIGS. 4 and 5) extending therethrough and intersecting the first and the second ends 120 and 122. The second lock tube 114 has a lock tube opening 138 (FIGS. 4 and 5) extending therethrough and intersecting the first and the second ends 124 and 126 thereof. The third lock tube 116 has a lock tube opening 140 (FIGS. 4 and 5) extending therethrough and intersecting the first and the second end 128 and 130 thereof. The fourth lock tube 118 has a lock tube opening 142 (FIGS. 4 and 5) extending therethrough and intersecting the first and the second ends 132 and 134 thereof.

The inside tube 64 has an opening 150 (FIGS. 4 and 5) which extends through the inside tube 64 intersecting the first and the second ends 66 and 68 thereof. The first lock tube 112 has an outer diameter which is less than the inner diameter formed by the opening 150 formed through the inside tube 64. The first lock tube 112 is disposed in the opening 150 in the inside tube 64 and positioned therein so that the first end 120 of the first lock tube 112 is spaced a distance from the first end 66 of the inside tube 64 and the second end 122 of the first lock tube 112 extends a distance beyond the second end 68 of the inside tube 64. The first lock tube 112 is rotatably disposed within the inside tube 64.

Figure 8:
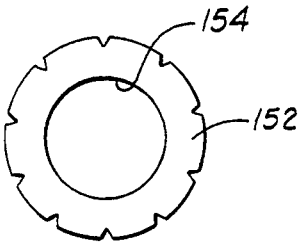
FIG. 8 is an end elevational view of the first thumb wheel.

A first thumb wheel 152 (FIGS. 1, 2, 3, 4, 5 and 8) is secured to the second end 122 of the first lock tube 112. More particularly, the first thumb wheel 152 includes an opening 154 (FIG. 8) formed therethrough and the second end 122 of the first lock tube 112 is disposed into the opening 152 and, in this position, the first thumb wheel 152 is secured to the first lock tube 112.

The second lock tube 114 has an outer diameter which is less than the inner diameter formed by the lock tube opening 136 through the first lock tube 112. The second lock tube 114 is disposed through the lock tube opening 136 in the first lock tube 112 and positioned therein so that the first end 124 of the second lock tube 114 is spaced a distance from the first end 66 of the inside tube 64 and is aligned with the first end 120 of the first lock tube 112. The second end 126 of the second lock tube 114 extends a distance beyond the second end 122 of the first lock tube 112.

Figure 9:
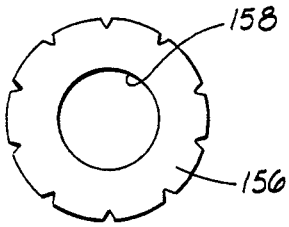
FIG. 9 is an end elevational view of the second thumb wheel.

A second thumb wheel 156 (FIGS. 1, 2, 3, 4, 5 and 9) is secured to the second end 126 of the second lock tube 114. More particularly, the second thumb wheel 156 includes an opening 158 (FIG. 9) formed therethrough and the second end 126 of the second lock tube 114 is disposed through the opening 158 and the second thumb wheel 156 is secured to the second lock tube 114 generally near the second end 126 thereof.

The second lock tube 114 has an outer diameter which is less than the inner diameter formed by the lock tube opening 136 through the first lock tube 112. The second lock tube 114 is rotatingly disposed in the lock tube opening 136 of the first lock tube 112.

The third lock tube 116 has an outer diameter which is less than the inner diameter formed by the lock tube opening 138 through the second lock tube 114. The third lock tube 116 is rotatingly disposed in the lock tube opening 138 and positioned therein so that the second end 130 of the third lock tube 116 is spaced a distance from the second end 68 of the inside tube 64 and is about aligned with the second ends 122 and 126 of the first and the second lock tubes 112 and 114, respectively. The second end 130 of the third lock tube 116 extends a distance beyond the second end 126 of the second lock tube 126.

Figure 10:
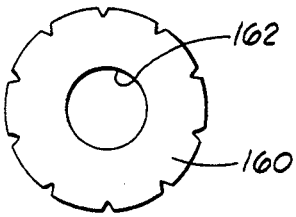
FIG. 10 is an end elevational view of the third thumb wheel.

A third thumb wheel 160 (FIGS. 1, 2, 3, 4, 5 and 10) is secured to the second end 130 of the third lock tube 116. More particularly, the third thumb wheel 160 includes an opening 162 (FIG. 10) formed therethrough and the second end 130 of the third lock tube 116 is disposed through the opening 162 and the third thumb wheel 160 is secured to the second end 130 of the third lock tube 116 in this position.

The fourth lock tube 118 has an outer diameter which is less than the inner diameter formed by the lock tube opening 140 extending through the third lock tube 116. The fourth lock tube 118 is rotatingly disposed through the lock tube opening 140 in the third lock tube 116 to a position wherein the first end 132 of the fourth lock tube 118 is spaced a distance from the first end 66 of the inside tube 64 and the first end of the fourth lock tube 118 is about aligned with the first ends 120, 124, and 128 of the first, the second and the third lock tubes 112, 114, and 116, respectively. The second end 134 of the fourth lock tube 118 extends a distance beyond the second end 130 of the third lock tube 116.

Figure 11:
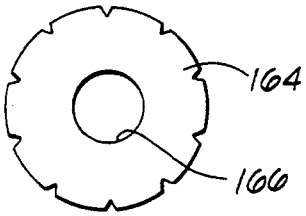
FIG. 11 is an end elevational view of the fourth thumb wheel.

A fourth thumb wheel 164 (FIGS. 1, 2, 3, 4, 5, and 11) is secured to the second end 134 of the fourth lock tube 118. More particularly, the fourth thumb wheel 164 includes an opening 166 (FIG. 11) extending therethrough. The second end 134 of the fourth lock tube 118 is disposed through the opening 166 and the fourth thumb wheel 164 secured to the fourth lock tube 118 in this position.

The plunger 28 is slidingly disposed in the tube assembly 12 or, more particularly, in the block tube 203 (described below). The second end 110 of the plunger 28 extending a distance beyond the second end 134 of the fourth lock tube 118 (shown more clearly in FIGS. 3, 4, and 5).

Figure 12:
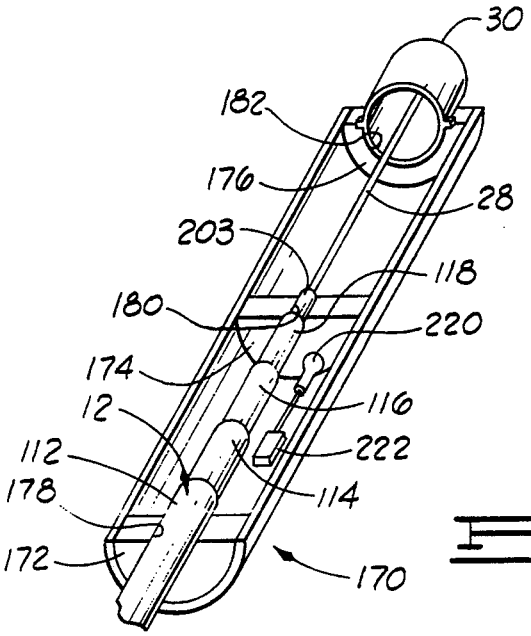
FIG. 12 is a partial perspective view showing the grip support portion of the hand grip and showing the position of the tube assembly disposed therein and the plunger cap.

The handle grip 52 includes a grip support 170 (FIG. 12). The grip support 170 includes three spaced apart bulkheads 172 (FIG. 12), 174 (FIG. 12), and 176 (FIG. 12). The bulkhead 172 and 174 each include a recess 178 and 180 respectively. The recesses 178 and 180 are sized so that the portions of the lock tubes 112, 114, 116, and 118 generally near the respective second ends 122, 126, 130, and 134 thereof are disposed in the recesses 178 and 180 so that the bulkheads 174 and 176 support the second end portions of the lock tubes 112, 114, 116, and 118. The thumb wheels 152, 156, 160, and 164 are disposed within the space between the bulkhead 172 and the bulkhead 174. The second end 110 of the plunger 28 extends beyond the bulkhead 174 and extends a distance beyond the bulkhead 176. The bulkhead 176 includes a recess 182 and the plunger cap 30 is disposed in the recess 182 of the bulkhead 176.

The plunger cap 30 includes a pair of flanges 184 (FIG. 3) and 186 (FIG. 3). The plunger cap 30 is disposed in the recess 182 and positioned so that the flanges 184 and 186 engage the bulkhead 176 to restrict movement of the plunger in the direction 104 to retain the plunger cap 30 slidingly connected to the grip support 170.

A plunger spring 188 is disposed between the bulkheads 174 and 176 and the plunger 28 extends through the plunger spring 188 and into engagement with the plunger cap 30. One end of the plunger spring 188 engages the bulkhead 174 and the opposite end of the plunger spring 188 engages the plunger cap 30. The plunger spring 188 biases the plunger cap 30 in the direction 104 to a position wherein the flanges 184 and 186 on the plunger cap 30 engage the bulkhead 176.

An outside cover 190 (FIGS. 1, 2, 3, 4, and 5) is disposed about the grip support 170. The outside cover 190 may be a formed elastomeric member for example. The outside cover 190 includes four wheel openings 192 (FIG. 3), 194 (FIG. 3), 196 (FIG. 3), and 198 (FIG. 3). The thumb wheels 152, 156, 160, and 164 are positioned within the grip support 170 and the outside cover 190 is connected to the grip support 170 and positioned thereon so that a portion of the first thumb wheel 152 extends through the wheel opening 192, a portion of the second thumb wheel 156 extends through the wheel opening 194, a portion of the third thumb wheel 160 extends through the wheel opening 196 and a portion of the fourth thumb wheel 164 extends through the wheel opening 198.

Figure 13:
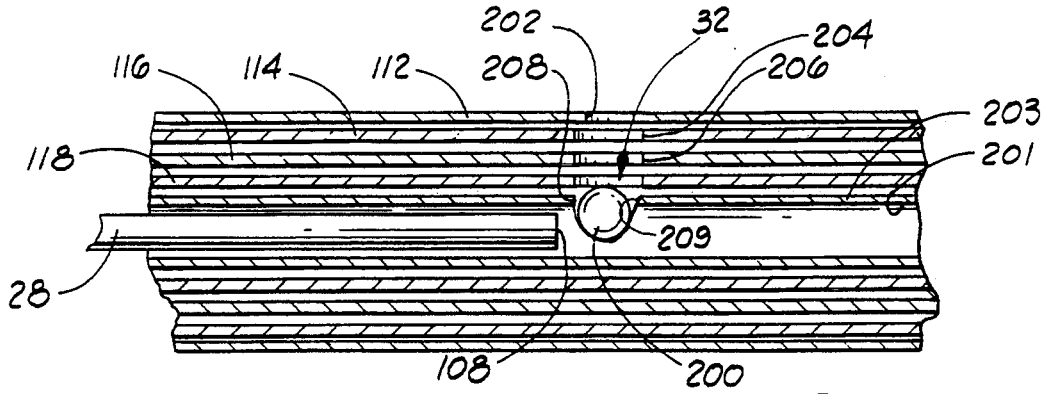
FIG. 13 is a partial sectional, enlarged view of the tube assembly showing the blocking assembly in the blocking position.

The blocking assembly 32 includes a blocking member 200 (FIGS. 4, 5, and 13) which is disposed in a block tube opening 201 (FIGS. 13 and 14) of a block tube 203 (FIGS. 4, 5 and 13) in a locking position of the locking assembly 32 (FIGS. 5 and 13). The block tube 203 is disposed in the lock tube opening 142 of the fourth lock tube 118, as shown more clearly in FIG. 13. One end of the block tube 203 extends beyond the end of the fourth lock tube 118 and is secured in the bulkhead 174 (FIG. 12) to prevent the block tube 203 from rotating. The plunger 28 slidingly extends through the block tube opening 201.

The blocking member 200 preferably is a spherically shaped ball bearing having a diameter slightly larger than the diameter formed by the block tube opening 201 in the block tube 203 so that, when the blocking member 200 is disposed in the block tube opening 201, the blocking member 200 is lodged therein, as shown more clearly in FIG. 13.

The block tube 203 has a rounded enlarged block opening 209 (FIGS. 13 and 14), and the lock tubes 112, 114, 116 and 118 each include lock openings 202 (FIG. 13), 204 (FIG. 13), 206 (FIG. 13) and 208 (FIG. 13), respectively. The block opening 209 formed through the block tube 203 is cut at an angle so that the blocking member 200 is disposed in the block tube 203 on a portion of the block tube 203 formed by the angled opening 209 in the locking position of the locking assembly 32. The lock openings 202, 204, 206, and 208 are positioned on the respective lock tubes 112, 114, 116, and 118 near and spaced a distance from their respective first ends 120, 124, 128, and 132 of the lock tubes 112, 114, 116, and 118, respectively so that the lock openings 202, 204, 206, and 208 each are disposed adjacent the blocking member 200, and each are alignable with the block opening 209.

The lock tubes 112, 114, 116, and 118 each are rotatable to a position wherein the lock openings 202, 204, 206, and 208 are aligned with the block opening 209, as shown in FIGS. 5 and 13. Further, the lock tubes 112, 114, 116, and 118 each are rotatable to various positions wherein one or more of the lock openings 202, 204, 206, and 208 are unaligned with the block opening 209 (FIG. 4). The unlocking combination of the lock assembly 34 is represented by the numbers on the respective thumb wheels 152, 156, 160, and 164 which are displayed through the wheel openings 192, 194, 196, and 198 when the lock tubes 112, 114, 116, and 118 have been rotated to the position wherein the lock openings 202, 204, 206, and 208 are aligned with the block opening 209. For example, shown in FIG. 5, the numerals 3217 are displayed by the respective thumb wheels 164, 160, 156, and 152 through the respective wheel openings 198, 196, 194, and 192 indicating that the lock tubes 118, 116, 114, and 112 respectively, connected thereto have been rotated to the position wherein the lock openings 208, 206, 204, and 202 are aligned with the block opening 209 thereby positioning the lock assembly 34 in the unlocked position. The numbers 3214 representing the unlocked position of the lock assembly 34 could be any combination of numbers since the particular combination of numbers representing the unlocked position of the lock assembly 34 is determined by the position at which the thumb wheels 152, 156, 160, and 164 are secured to the respective lock tubes 112, 114, 116, and 118 or simply the numbers on the thumb wheels 152, 156, 160 and 164 when the lock tubes 112, 114, 116, and 118 are rotatingly positioned to align the respective lock openings 202, 204, 206, and 208 with the block opening 209. Thus, the numbers 3217 have been shown in the drawings merely for illustrative purposes only.

Assuming the lock assembly 34 has an unlocked position represented by the combination of numerals 3217 displayed on the respective thumb wheels 164, 160, 156 and 152 as shown in FIGS. 1 and 5 and further assuming that the lock tubes 118, 116, 114, and 112 have been rotated to a position wherein the numbers 5074 are displayed on the respective thumb wheels 164, 160, 156, and 152 respectively (as shown in FIGS. 1 and 4) thereby positioning the lock assembly in the locked position, the spring 188 biases the plunger 30 in the direction 104 to the position wherein the flanges 184 and 186 on the plunger cap 30 engage the bulkhead 176 and the first end 108 of the plunger 28 is disposed near the blocking member 200 with the blocking member 200 being disposed in the locked tube opening 142 of the fourth lock tube 118 interposed between the second end 110 of the plunger 128 and the pin end 98 formed on the reduced diameter portion 96 of the pin 90. In this position, the blocking member 200 is lodged in the block tube 203 and, if the plunger cap 30 is depressed or moved in the direction 106, the first end 108 of the plunger 28 engages the blocking member 200 and the blocking member 200 prevents further movement of the plunger 28 in the direction 106. In this locked position of the locked assembly 34, the spring 102 biases the pin 90 to the position wherein the pin head 92 engages the stop housing 72 and the enlarged diameter portion 94 of the pin 90 is disposed in the stop chamber 74. The enlarged diameter portion 94 of the pin 90 moves the stop members 84, 86, and 88 outwardly through the respective stop openings 76, 78, and 80 to positions wherein portions of the stop members 84, 86, and 88 are extending radially outwardly beyond the outer peripheral surface 18 of the outside tube 56. In this lock position of the lock assembly 34, the tube assembly 12 cannot be inserted through the barrel bore 92 of the firearm 26 because the portions of the stop members 84, 86, and 88 extending beyond the outer peripheral surface 18 of the tube assembly 12 creates an effective outer peripheral diameter which is larger than the bore diameter 44.

To insert the safety device 12 into the firearm 26, the operator first must rotate the lock tubes 112, 114, 116, and 118 by rotatingly manipulating the thumb wheels 152, 156, 160, and 164 to positions wherein the numerals 3217, for example, appear through the respective openings 198, 196, 194, and 192 in the outside cover 190 of the hand grip 52 thereby indicating that the lock tubes 112, 114, 116, and 118, have been rotated to positions wherein the lock openings 202, 204, 206, and 208 are aligned with the block opening 209, as shown in FIG. 5, thereby positioning the lock assembly 34 in the unlocked position. In the unlocked position of the lock assembly 34, the individual grips the hand grip 52 and with the individual's palm depresses the plunger cap 30 moving the plunger cap 30 in the direction 106 against the biasing force of the spring 188. The movement of the plunger cap 30 in the direction 106 moves the plunger 28 in the direction 106 thereby moving the first end 108 of the plunger 28 in the direction 106 to a position wherein the first end 108 of the plunger 28 engages the blocking member 200.

As the plunger 28 is further moved in the direction 106, the first end 108 of the plunger 28 engages the blocking member 200 moving the blocking member 200 up the incline plane formed by the angled lock opening 209 in the block tube 203 and out through the block opening 209 in the block tube 203. Since the lock openings 202, 204, 206, and 208 are aligned, the blocking member 200 is moved by the plunger 28 out through the lock opening 208 and through the lock opening 206 in the third lock tube 116 and through the lock opening 204 in the second lock tube 114 thereby permitting the portion of the plunger 28 near the first end 108 thereof to be moved past the blocking member 200 and through the opening 201 in the block tube 203.

Since the lock opening 202 in the first lock tube 112 is smaller than the blocking member 200, the blocking member 200 is prevented from moving through the lock opening 202 and captured within the lock openings 204, 206, and 208. When the blocking member 200 is moved into the lock openings 208, 206, and 204 and out of the lock tube opening 142 of the fourth lock tube 118, the blocking assembly 32 is positioned in the unblocking position thereby permitting the plunger 28 to be moved through the block tube 203. The plunger 28 further is moved by depressing the plunger cap 30 in the direction 106 to a position wherein the first end 108 of the plunger 28 engages the pin end 98 of the pin 90.

As the plunger 28 further is moved in the direction 106, the plunger 28 moves the pin 90 in the direction 106 by virtue of the engagement between the first end 108 of the plunger 28 and the pin end 98 of the pin 90. The plunger 28 is moved in the direction 106 thereby moving the pin 90 in the direction 106 until the pin 90 is in a position wherein the reduced diameter portion 96 of the pin 90 is positioned within the stop chamber 74. As the reduced diameter portion 96 is positioned within the stop chamber 74, the stop members 84, 86, and 88 are permitted to drop onto the reduced diameter portion 96 thereby removing the stop members 84, 86, and 88 from the stop openings 58, 60, and 62 and positioning the firearm safety device 10 in the unlocked position.

In the unlocked position and with the individual maintaining the plunger cap 30 depressed in the direction 106 to hold the firearm safety device 10 in the unlocked position, the tube assembly 12 now can be inserted into the bore diameter 44 of the barrel bore 42 since the stop members 84, 86, and 88 have been removed from the stop openings 58, 60, and 62. The individual now moves the tube assembly 12 into and through the barrel bore 42 and through the cartridge chamber 48 aligned with the barrel bore 42 to a position shown in FIG. 15 and to a position shown in FIG. 2 except for the fact that the cylinder 46 is in the nonoperating position in FIG. 2.

When the tube assembly 12 has been positioned in the barrel bore 42 and the aligned cartridge chamber 48, the individual then releases the plunger 28 thereby permitting the plunger cap 30 and the plunger 28 connected thereto to be moved in the direction 104 by the biasing force of spring 188. The plunger 28 is moved in the direction 104 via the biasing force of the spring 188 to a position wherein the first end 108 of the plunger 28 has been moved past the blocking member 200 thereby permitting the blocking member 200 to drop through the lock openings 204, 206 and 208 and through the block opening 209 and back into the block tube opening 201 of the block tube 203 and positioning the blocking assembly 32 in the blocking position.

As the plunger 28 is moved in the direction 104 past the blocking member 108, the spring 102 biases the pin 90 in the direction 104 thereby moving the enlarged diameter portion 96 of the pin 90 into the stop chamber 74. The enlarged diameter portion 96 engages the stop members 84, 86, and 88 and moves the stop members 84, 86, and 88 through the respective stop openings 58, 60, and 62 to the position wherein a portion of each of the stop members 84, 86, and 88 extends a distance beyond the outer peripheral surface 18 of the tube assembly 12.

The thumb wheels 152, 156, 160, and 164 then are rotated to position the lock assembly 34 in the lock position illustrated in FIG. 4 by the respective reference numerals 5074, for example, on the respective thumb wheels 164, 160, 156, and 152 wherein the lock openings 202, 204, 206, and 208 are misaligned or unaligned with the block opening 209. The lock assembly 34 thus is positioned in the lock position locking the stop members 84, 86, and 88 in a position wherein a portion of each of the stop members 84, 86, and 88 extends a distance beyond the outer peripheral surface 18 of the tube assembly 12.

The stop assembly 22 is positioned on the tube assembly 12 for engaging the portion of the firearm 26 to prevent removal of the tube assembly 12 from the firearm 26 in the locking position of the stop assembly 22. More particularly, as illustrated in the FIGS. 2 and 15, the stop assembly 22 is positioned on the tube assembly 12 so that the portions of the stop members 84, 86, and 88 extending beyond the outer peripheral surface 18 of the tube assembly 12 engage the second end 40 of the barrel 36 thereby preventing the tube assembly 12 from being moved in a direction from the second end toward the first end of the barrel (a removal direction). In this locked position of the firearm safety device 10, the tube assembly 12 extends through the barrel 36 and a portion of the tube assembly 12 extends through the cartridge chamber 48 aligned with the barrel bore 42 thereby preventing the operation of the firearm 26 to discharge ammunition. The tube assembly 12 cannot be removed from the barrel bore 42 until someone manipulates the thumb wheels 152, 156, 160, and 164 to positions displaying the combination resulting in the lock tubes 112, 114, 116, and 118 being positioned to align with the respective lock tubes 202, 204, 206, and 208 with the block opening 209.

When it is desired to remove the firearm safety device 10 from the firearm 26, the thumb wheels 152, 156, 160, and 164 are rotatingly manipulated by the operator until the proper combination 5074, for example, is displayed through the respective wheel openings 198, 196, 194, and 192 thereby indicating that the lock tubes 112, 114, 116, and 118 have been positioned in the proper position for aligning the lock openings 202, 204, 206, and 208 with the block opening 209 and positioning the lock assembly 24 in the unlock position. In this unlock position of the lock assembly 24, the operator then can depress the plunger cap 30 thereby moving the first end 108 of the plunger 28 into engagement with the blocking member 200 and moving the blocking member 200 through the block opening 209 and through the lock openings 202, 204, 206, and 208 so that the plunger 28 again can engage the pin end 98 of the pin 90 for moving the reduced diameter portion 96 into the stop chamber 74 causing the stop members 84, 86, and 88 to be removed from the respective stop openings 58, 60, and 62. In this unlocked position, the firearm safety device 10 then can be removed from the barrel bore 42 and the align cartridge chamber 48.

Figure 16:
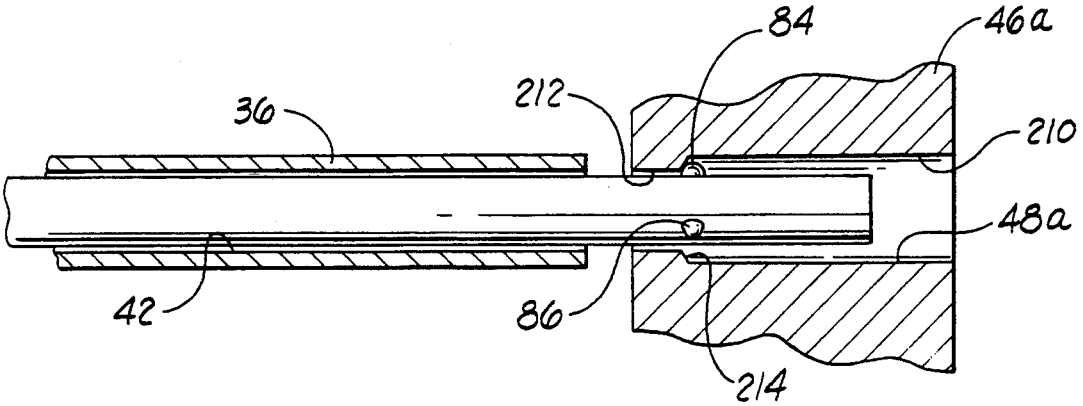
FIG. 16 is a view of a barrel and a modified cylinder showing where the tube assembly may be positioned in the cylinder in a locking position in one modified embodiment of a firearm.

In some firearms, the cartridge chamber 48 includes an enlarged diameter portion 210 (FIG. 16) and reduced diameter portion 212 (FIG. 16) forming a ridge 214 (FIG. 16) therebetween. In these instances, the stop assembly 22 may be positioned on the tube assembly 12 so that the stop members 84, 86, and 88 engage the ridge 214 in the aligned cartridge chamber **48*a* to prevent removal of the firearm safety device 10 from the barrel bore 42 and the aligned cartridge chamber 48*a***.

To assemble the lock tubes 112, 114, 116 and 118, the fourth lock tube 118 initially is positioned within the lock tube opening 140 of the third lock tube 116 in the proper position as described before. Then, the third lock tube 116 is crimped through the fourth lock tube 118 in a manner which prevents axial movement of the fourth lock tube 118 with respect to the third lock tube 116 and yet which permits rotational movement of the third lock tube 116 relative to the fourth lock tube 118 or rotational movement of the fourth lock tube 118 relative to the third lock tube 116. The third and the fourth lock tubes 116 and 118 then are positioned within the lock tube opening 138 of the second lock tube 114 in the predetermined position described before. In this position, the second lock tube 114 is crimped to the third locked tube 116 in a manner which prevents axial movement of the second lock tube 114 relative to the third lock tube 116 and prevents axial movement of the third lock tube 116 relative to the second lock tube 114 yet which permits rotational movement of the second lock tube 114 relative to the third lock tube 116 or rotational movement of the third lock tube 116 relative to the second lock tube 114. The second lock tube 114, the third lock tube 116 and the fourth lock tube 118 then are positioned within the lock tube opening 136 in the predetermined position described before. In this position, the first lock tube 112 is crimped to the second lock tube 114 in a manner which prevents axial movement of the first lock tube 112 relative to the second lock tube 114 or axial movement of the second lock tube 114 relative to the first lock tube 112 yet which permits rotational movement of the first lock tube 112 relative to the second lock tube 114 or rotational movement of the second lock tube 114 relative to the first lock tube 112.

It should be noted that, although four thumb wheels 152, 156, 160 and 164 have been shown connected to four lock tubes 112, 114, 116 and 118, a particular lock assembly 34 may include two or three lock wheels if desired in a particular application. The four thumb wheels 152, 156, 160 and 164 have been shown in the preferred embodiment because it is more difficult for one to inadvertently dial the proper combination to align the lock openings 202, 204, 206 and 208 and position the lock assembly 34 in the unlocked position when utilizing four thumb wheels and four lock tubes.

As shown in dashed lines in FIG. 1 and as shown in FIG. 12, a light 220 connected to a battery 222 also preferably is disposed within the hand grip 52 and supported within the grip support 170. A switch arm 224 (FIG. 1) is connected to a switch (not shown) interposed between light 220 and a battery 222. When the switch arm 224 is depressed, electrical continuity is established between the light 220 and the battery 222 causing the light 220 to be lighted. The light 220 in a lighted condition illuminates the thumb wheels 152, 156, 160 and 164 so that the numerals appearing on the thumb wheels 152, 156, 160 and 164 may be observed by the operator in a dark room. In this embodiment, the thumb wheels 152, 154, 160 and 164 preferably are constructed of a transparent or light transmitting plastic material, for example.

Figure 17:
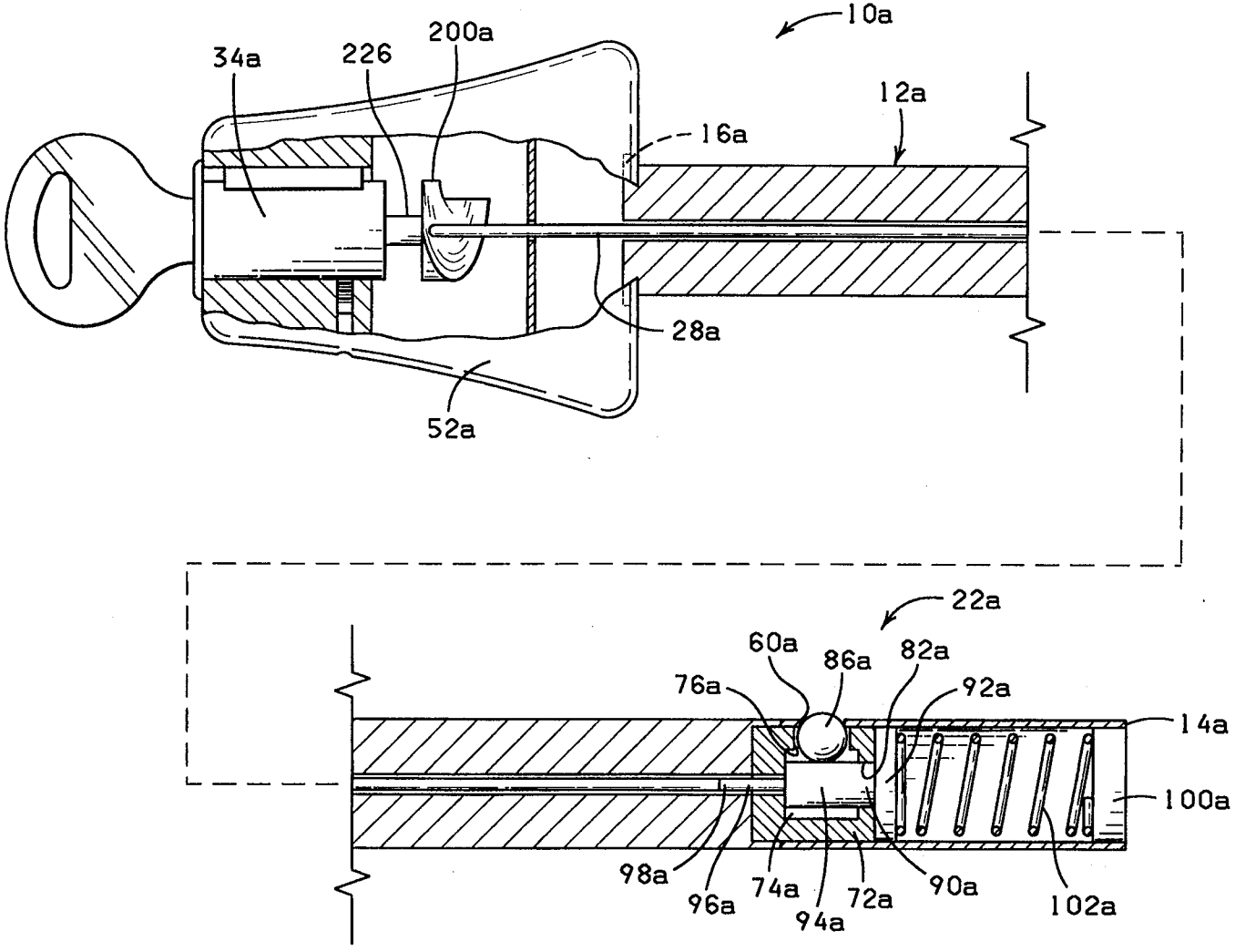
FIG. 17 is a sectional view of a modified firearm safety device adapted for use with a key lock.

In lieu of a combination lock such as described before with respect to the lock assembly 34, a key type lock **34*a* (FIG. 17) may be utilized although the combination lock is preferred. With the key type lock 34*a*, it is not necessary to use the four lock tubes 112, 114, 116 and 118. It only is necessary to connect the key type lock 34*a* to a member 226 for moving the stop member 86*a* to the unlocking position. In this embodiment, the block member may be something other than a ball bearing such as an arm 200*a* connected to the member 226 which is connected to the key lock 34*a* so that when the key lock 34*a* is turned, the arm 200*a*** is moved to the unblocking position.

It also should be noted that, in lieu of the ball bearing type stop members 84, 86 and 88, the stop members may be arms which are pivotable to the locked position and the unlocked position. The pivoting of such arms may be actuated via an enlarged portion or flange on the end 108 of the plunger 28 for example.

It should be noted that the outside tube could be constructed of a flexible material such as an elastomeric material, and portions of the outside tube could be pushed or moved outwardly to engage the firearm in the locking position of the stop assembly. In this embodiment, the portion of the outside tube which is moved outwardly to engage the firearm is a part of the stop assembly.

Changes may be made in the construction and the operation of the various components, elements and assemblies described herein without departing from the spirit and scope of the invention as defined in the following claims.

What is claimed is:

1. A firearm safety device for preventing the discharge of a firearm wherein the firearm comprises a barrel with a barrel bore extending therethrough, comprising:

a tube assembly having a first end and a second end and having an outer peripheral surface sized so that the first end of the tube assembly is insertable through the barrel bore;

a stop assembly having a stop member which is spherically shaped, the stop assembly being connected to the tube assembly having a locking position and an unlocking position, a portion of the stop member extending a distance beyond the outer peripheral surface of the tube assembly in the locking position of the stop assembly;

a lock assembly connected to the tube assembly having a locked position and an unlocked position; and means for engaging the stop assembly and moving the stop assembly to the unlocking position in the unlocked position of the lock assembly, said stop assembly being moved to the locking position when disengaged from said means, and said means being prevented from engaging the stop assembly and moving the stop assembly to the unlocking position in the locked position of the lock assembly, the tube assembly being insertable into the barrel bore in the unlocking position of the stop assembly and the unlocked position of the lock assembly and the portion of the stop member extending outwardly from the outer peripheral surface of the tube assembly in the locking position of the stop assembly engaging a portion of the firearm for preventing the removal of the tube assembly from the barrel bore of the barrel in the locking position of the stop assembly.

2. The firearm safety device of claim 1 wherein the means for engaging the stop assembly further comprises:

a plunger having a first end and a second end movably disposed in the tube assembly for movement in one direction toward the stop assembly and movable in an opposite direction away from the stop assembly; and wherein the firearm safety device further comprises a blocking assembly which comprises:

a blocking member disposed in the tube assembly interposed between the first end of the plunger and the stop assembly for blocking the plunger from moving toward and into engagement with the stop assembly in a blocking position of the blocking assembly, and wherein the lock assembly is further defined as holding the blocking assembly in the blocking position in the locked position of the lock assembly, and permitting the blocking assembly to be moved to the unblocking position in the unlocked position of the lock assembly.

3. The firearm safety device of claim 2 wherein the lock assembly further comprises:

at least two lock tubes with each lock tube having a lock tube opening formed therethrough, the lock tubes being rotatable relative to each other to one position wherein the lock tube openings in the lock tubes are aligned in the unlocked position of the lock assembly, the blocking member being disposed in the lock tubes and being movable through the lock tube openings to the unblocking position in an aligned position of the lock tube openings, the first end of the plunger being engagable with the blocking member for moving the blocking member through the lock tube openings in the lock tubes to the unblocking position in the unlocked position of the lock assembly for permitting the first end of the plunger to move into an engagement with the stop assembly; and means for rotating each of the lock tubes to an unlocked position of the lock assembly wherein the lock tube openings in the lock tubes are aligned and for moving the lock tubes to a locked position of the lock assembly wherein at least one of the lock tube openings is not aligned with its corresponding lock tube openings.

4. The firearm safety device of claim 3 further comprising:

a block tube disposed in the lock tubes having a block tube opening formed therethrough and a block opening formed through a portion thereof, the blocking member being disposed in the block tube opening and the lock tube openings in the lock tubes being rotatable to a position aligned with the block opening in the block tube in the unlocked position of the lock assembly.

5. The firearm safety device of claim 1 wherein the tube assembly comprises an outer tube having a first end and a second end, the first end of the outer tube forming the first end of the tube assembly and the second end of the outer tube forming the second end of the tube assembly, the outer tube having an outer peripheral surface forming the outer peripheral surface of the tube assembly, the outer tube having an opening extending therethrough, the outer tube having three stop openings formed therethrough the outer peripheral surface thereof, and wherein the stop assembly further comprises:

a stop housing having a stop chamber formed in a portion thereof with three stop openings being formed through the stop housing in communication with the stop chamber, the stop chamber being positioned in the opening in the outer tube so that the stop openings in the stop housing are aligned with the stop openings in the outer tube;

three stop members disposed in the stop housing, at least a portion of each of the stop members being movable through one of the stop openings in the stop housing and through one of the stop openings in the outer tube and extending a distance beyond the outer peripheral surface of one of the outer tubes in the locking position of the stop assembly and at least a portion of each of the stop members being disposed in the stop chamber with no portion of the stop members extending beyond the outer peripheral surface of one of the outer tubes in the unlocking position of the stop assembly;

bias means for moving the stop member to the locking position; and said means for engaging the stop assembly and moving the stop assembly to the unlocking position is defined further as engaging the stop assembly and moving the stop assembly to the unlocking position against said bias means, said bias means automatically moving the stop member to the locking position when said means for engaging the stop assembly is disengaged from the stop assembly.

6. The firearm safety device of claim 5 wherein the stop housing further comprises a pin opening formed through a portion thereof in communication with the stop chamber, and wherein the bias means further comprises:

a pin having a portion extending through the pin opening and the stop housing and through the stop chamber, the pin having a portion engaging each of the stop members for moving each of the stop members to the locking position and having another portion for permitting each of the stop members to be moved to the unlocking position;

a spring disposed in the opening in the outer tube, a portion of the spring engaging the pin for moving the pin to a position wherein the portion of the pin adapted to engage each of the stop members and move each of the stop members to the locking position is disposed in the stop chamber and engages each of the stop members and moves each of the stop members to the locking position.

7. The firearm safety device of claim 6 wherein the stop members are defined further as being spherically shaped members, and wherein the pin is defined further to comprise a pin head having an enlarged diameter portion connected thereto forming the portion of the pin engagable with the stop members for moving the stop members to the locking position and a reduced diameter portion connected to the enlarged diameter portion and comprising the portion of the pin permitting the stop members to be moved to the unlocking position.

8. The firearm safety device of claim 6 wherein the means for engaging the stop assembly further comprises:

a plunger having a first end and a second end, the plunger being disposed in the opening in the outer tube with the first end of the plunger being disposed near and spaced a distance from the pin in the locked position of the lock assembly, a plunger cap being connected to the second end of the plunger, the plunger being movable in one direction toward the pin and movable in an opposite direction away from the pin, the first end of the plunger being engagable with a portion of the pin for moving the pin in a direction against the force of the spring engaging the pin for moving the pin to a position permitting the stop members to be moved to the unlocking position, the plunger being movable in the direction away from the pin for permitting the spring to move the pin back to the position for engaging the stop members and moving the stop members to the locking position.

9. The firearm safety device of claim 8 further comprising:

a blocking assembly interposed between the first end of the plunger and the pin in the locked position of the lock assembly and being removable from between the first end of the plunger and the pin in an unlocked position of the lock assembly, the first end of the pin being engagable with a portion of the blocking assembly for removing the blocking assembly from between the first end of the plunger and the pin and permitting the plunger to be moved in the direction toward the pin for engaging the pin and moving the stop assembly to the unlocking position, a portion of the blocking assembly being interposed between the first end of the plunger and the pin for preventing the plunger from being moved in the direction toward the pin and engaging the pin in the locked position of the lock assembly.

10. The firearm safety device of claim 1 wherein the tube assembly comprises an outer tube having a first end and a second end, the first end of the outer tube forming to the first end of the tube assembly and the second end of the outer tube forming to the second end of the tube assembly, the outer tube having an outer peripheral surface forming to the outer peripheral surface of the tube assembly, the outer tube having an opening extending therethrough, the outer tube having a stop opening formed therethrough the outer peripheral surface thereof, and wherein the stop assembly further comprises:

a stop housing having a stop chamber formed in a portion thereof with a stop opening being formed through the stop housing in communication with the stop chamber, the stop chamber being positioned in the opening in the outer tube so that the stop opening in the stop housing is aligned with the stop opening in the outer tube;

the stop member disposed in the stop housing, at least a portion of the stop member being movable through the stop opening in the stop housing and through the stop opening in the outer tube and a portion of the stop member extending a distance beyond the outer peripheral surface of the outer tube in the locking position of the stop assembly and at least a portion of the stop member extending beyond the outer peripheral surface of the outer tube in the unlocking position of the stop assembly.

11. The firearm safety device of claim 10 wherein the stop assembly further comprises:

bias means for moving the stop member to the locking position; and wherein said means for engaging the stop assembly and moving the stop assembly to the unlocking position is defined further as engaging the stop assembly and moving the stop assembly to the unlocking position against said bias means, said bias means automatically moving the stop member to the locking position when said means for engaging the stop assembly is disengaged from the stop assembly.

12. The firearm safety device of claim 11 wherein the stop housing further comprises a pin opening formed through a portion thereof in communication with the stop chamber, and wherein the bias means further comprises:

a pin having a portion extending through the pin opening and the stop housing and through the stop chamber, the pin having a portion engaging the stop member for moving the stop member to the locking position and having another portion for permitting the stop member to be moved to the unlocking position;

a spring disposed in the opening in the outer tube, a portion of the spring engaging the pin for moving the pin to a position wherein the portion of the pin adapted to engage the stop member and move the stop member to the locking position is disposed in the stop chamber and engages the stop member and moves the stop member to the locking position.

13. The firearm safety device of claim 12 wherein the pin is defined further to comprise a pin head having an enlarged diameter portion connected thereto forming the portion of the pin engagable with the stop member for moving the stop member to the locking position and a reduced diameter portion connected to the enlarged diameter portion and comprising the portion of the pin permitting the stop member to be moved to the unlocking position.

14. The firearm safety device of claim 12 wherein the means for engaging the stop assembly further comprises:

a plunger having a first end and a second end, the plunger being disposed in the tube assembly with the first end of the plunger being disposed near and spaced a distance from the pin in the locked position of the lock assembly, a plunger cap being connected to the second end of the plunger, the plunger being movable in one direction toward the pin and movable in an opposite direction away from the pin, the first end of the plunger being engagable with a portion of the pin for moving the pin in a direction against the force of the spring engaging the pin for moving the pin to a position permitting the stop member to be moved to the unlocking position, the plunger being movable in the direction away from the pin for permitting the spring to move the pin back to the position for engaging the stop member and moving the stop member to the locking position.

15. The firearm safety device of claim 14 further comprising:

a blocking assembly interposed between the first end of the plunger and the pin in the locked position of the lock assembly and being removable from between the first end of the plunger and the pin in an unlocked position of the lock assembly, the first end of the plunger being engagable with a portion of the blocking assembly for removing the blocking assembly from between the first end of the plunger and the pin and permitting the plunger to be moved in the direction toward the pin for engaging the pin and moving the stop assembly to the unlocking position, a portion of the blocking assembly being interposed between the first end of the plunger and the pin for preventing the plunger from being moved in the direction toward the pin and engaging the pin in the locked position of the lock assembly.

16. The firearm safety device of claim 15 further comprising:

a plunger spring engagable with at least one of the plunger cap and the plunger for biasing the plunger cap and the plunger connected thereto in a direction moving the plunger in a direction away from the pin.

17. A firearm safety device for preventing the discharge of the firearm wherein the firearm comprises a barrel having a barrel bore extending therethrough, comprising:

an outer tube having an outer peripheral surface, a first end and a second end, an opening being formed through the outer tube, the outer peripheral surface being sized so that the first end of the outer tube is insertable through the barrel bore in an insertion direction and removable from the barrel bore in a removable direction, the outer tube having a stop opening formed through a portion thereof intersecting the outer peripheral surface and intersecting the opening through the outer tube, a rod opening being formed through a stop housing;

a stop assembly disposed in the opening in the outer tube having a locking position and an unlocking position, the stop assembly comprising:

the stop housing having a stop chamber formed in a portion thereof with a stop opening being formed through the stop housing in communication with the stop chamber, the stop chamber being positioned in the opening in the outer tube so that the stop opening in the stop housing is aligned with the stop opening in the outer tube;

a stop member disposed in the stop housing, at least a portion of the stop member being movable through the stop opening in the stop housing and through the stop opening in the outer tube and extending a distance beyond the outer peripheral surface of the outer tube in the locking position of the stop assembly and at least a portion of the stop member being disposed in the stop chamber with no portion of the stop member extending beyond the outer peripheral surface of the outer tube in the unlocking position of the stop assembly; and bias means for moving the stop member to the locking position; and a pin having a first end and a second end disposed in the opening in the outer tube, the pin being movable in one direction through the plunger opening in the stop housing for engaging the stop member and moving the stop member through the stop opening in the stop housing to a position wherein a portion of the stop member extends through the stop opening in the outer tube and a distance beyond the outer peripheral surface of the outer tube to position the stop assembly in the locking position, the pin being movable in an opposite direction for permitting the stop member to be moved into the stop chamber to the unlocking position of the stop assembly.

18. The firearm safety device of claim 17 wherein the stop housing further comprises a pin opening formed through a portion thereof in communication with the stop chamber, and wherein the bias means further comprises:

the pin having a portion extending through the pin opening and the stop housing and through the stop chamber, the pin having a portion engaging the stop member for moving the stop member to the locking position and having another portion for permitting the stop member to be moved to the unlocking position;

a spring disposed in the opening in the outer tube, a portion of the spring engaging the pin for moving the pin to a position wherein the portion of the pin adapted to engage the stop member and move the stop member to the locking position is disposed in the stop chamber and engages the stop member and moves the stop member to the locking position.

19. The firearm safety device of claim 18 wherein the stop member is defined further as being a spherically shaped member, and wherein the pin is defined further to comprise a pin head having an enlarged diameter portion connected thereto forming the portion of the pin engagable with the stop member for moving the stop member to the locking position and a reduced diameter portion connected to the enlarged diameter portion and comprising the portion of the pin permitting the stop member to be moved to the unlocking position.

20. The firearm safety device of claim 19 further comprising:

a plunger having a first end and a second end, the plunger being disposed in the opening in the outer tube with the first end of the plunger being disposed near and spaced a distance from the pin in the locked position of the lock assembly, a plunger cap being connected to the second end of the plunger, the plunger being movable in one direction toward the pin and movable in an opposite direction away from the pin, the first end of the plunger being engagable with a portion of the pin for moving the pin in a direction against the force of the spring engaging the pin for moving the pin to a position permitting the stop member to be moved to the unlocking position, the plunger being movable in the direction away from the pin for permitting the spring to move the pin back to the position for engaging the stop member and moving the stop member to the locking position.

21. The firearm safety device of claim 20 further comprising:

a blocking assembly interposed between the first end of the plunger and the pin in the locked position of the lock assembly and being removable from between the first end of the plunger and the pin in an unlocked position of the lock assembly, the first end of the pin being engagable with a portion of the blocking assembly for removing the blocking assembly from between the first end of the plunger and the pin and permitting the plunger to be moved in the direction toward the pin for engaging the pin and moving the stop assembly to the unlocking position, a portion of the blocking assembly being interposed between the first end of the plunger and the pin for preventing the plunger from being moved in the direction toward the pin and engaging the pin in the locked position of the lock assembly.

22. The firearm safety device of claim 21 further comprising:

a plunger spring engagable with at least one of the plunger cap and the plunger for biasing the plunger cap and the plunger connected thereto in a direction moving the plunger in a direction away from the pin.

23. A firearm safety device for preventing the discharge of the firearm wherein the firearm comprises a barrel having a barrel bore extending therethrough, comprising:

an outer tube having an outer peripheral surface, a first end and a second end, an opening being formed through the outer tube, the outer peripheral surface being sized so that the first end of the outer tube is insertable through the barrel bore in an insertion direction and removable from the barrel bore in a removable direction, the outer tube having three stop openings formed through a portion thereof intersecting the outer peripheral surface and intersecting the opening through the outer tube;

a stop assembly disposed in the opening in the outer tube having a locking position and an unlocking position, the stop assembly comprising:

a stop housing having a stop chamber formed in a portion thereof with three stop openings being formed through the stop housing in communication with the stop chamber, the stop chamber being positioned in the opening in the outer tube so that the stop openings in the stop housing are aligned with the stop openings in the outer tube, a rod opening being formed through the stop housing;

three stop members disposed in the stop housing, at least a portion of the stop members being movable through the stop openings in the stop housings and through the stop openings in the outer tube and extending a distance beyond the outer peripheral surface of the outer tube in the locking position of the stop assembly and at least a portion of each of the stop members being disposed in the stop chamber with no portion of the stop members extending beyond the outer peripheral surface of the outer tubes in the unlocking position of the stop assembly; and bias means for moving the stop members to the locking position; and a pin having a first end and a second end disposed in the opening in the outer tube, the pin being movable in one direction through the rod opening in the stop housing for engaging the stop members and moving the stop members through the stop openings in the stop housing to a position wherein a portion of each of the stop members extends through each of the stop openings in the outer tube and a distance beyond the outer peripheral surface of the outer tube to position the stop assembly in the locking position, the pin being movable in an opposite direction for permitting the stop members to be moved into the stop chamber to the unlocking position of the stop assembly.

24. The firearm safety device of claim 23 wherein the stop housing further comprises a pin opening formed through a portion thereof in communication with the stop chamber, and wherein the bias means further comprises:

the pin having a portion extending through the pin opening and the stop housing and through the stop chamber, the pin having a portion engaging the stop members for moving the stop members to the locking position and having another portion for permitting the stop members to be moved to the unlocking position;

a spring disposed in the opening in the outer tube, a portion of the spring engaging the pin for moving the pin to a position wherein the portion of the pin adapted to engage the stop members and move the stop members to the locking position is disposed in the stop chamber and engages the stop members and moves the stop members to the locking position.

25. The firearm safety device of claim 24 wherein the stop members are defined further as being spherically shaped members, and wherein the pin is defined further to comprise a pin head having an enlarged diameter portion connected thereto forming the portion of the pin engagable with the stop members for moving the stop members to the locking position and a reduced diameter portion connected to the enlarged diameter portion and comprising the portion of the pin permitting the stop members to be moved to the unlocking position.

26. The firearm safety device of claim 25 further comprising:

a plunger having a first end and a second end, the plunger being disposed in the opening in the outer tube with the first end of the plunger being disposed near and spaced a distance from the pin in the locked position of the lock assembly, a plunger cap being connected to the second end of the plunger, the plunger being movable in one direction toward the pin and movable in an opposite direction away from the pin, the first end of the plunger being engagable with a portion of the pin for moving the pin in a direction against the force of the spring engaging the pin for moving the pin to a position permitting the stop members to be moved to the unlocking position, the plunger being movable in the direction away from the pin for permitting the spring to move the pin back to the position for engaging the stop members and moving the stop members to the locking position.

27. The firearm safety device of claim 26 further comprising:

a blocking assembly interposed between the first end of the plunger and the pin in the locked position of the lock assembly and being removable from between the first end of the plunger and the pin in an unlocked position of the lock assembly, the first end of the pin being engagable with a portion of the blocking assembly for removing the blocking assembly from between the first end of the plunger and the pin and permitting the plunger to be moved in the direction toward the pin for engaging the pin and moving the stop assembly to the unlocking position, a portion of the blocking assembly being interposed between the first end of the plunger and the pin for preventing the plunger from being moved in the direction toward the pin and engaging the pin in the locked position of the lock assembly.

28. The firearm safety device of claim 27 further comprising:

a plunger spring engagable with at least one of the plunger cap and the plunger for biasing the plunger cap and the plunger connected thereto in a direction moving the plunger in a direction away from the pin.

29. A firearm safety device for preventing the discharge of a firearm wherein the firearm comprises a barrel having a barrel bore, the firearm safety device comprising:

an outer tube having a first end, a second end and an outer peripheral surface, the outer peripheral surface being sized so that the first end of the outer tube is insertable in an insertion direction into the barrel bore and so that the outer tube is movable in the outer bore in a removal direction for removing the outer tube from the barrel bore, the outer tube having a stop opening formed through a portion thereof intersecting the outer peripheral surface and intersecting an opening formed through the outer tube;

a stop assembly disposed in the opening in the outer tube having a locking position and an unlocking position, the stop assembly comprising:

a stop housing having a stop chamber formed in a portion thereof with a stop opening being formed through the stop housing in communication with the stop chamber, the stop housing being positioned in the opening in the outer tube so that the stop opening in the stop housing is aligned with the stop opening in the outer tube, a rod opening being formed in the stop housing;

a stop member disposed in the stop housing, at least a portion of the stop member being movable through the stop opening in the stop housing and through the stop opening in the outer tube and extending a distance beyond the outer peripheral surface of the outer tube in the locking position of the stop assembly and at least a portion of the stop member being disposed in the stop chamber with no portion of the stop member extending beyond the outer peripheral surface of the outer tube in the unlocking position of the stop assembly;

a plunger having a first end and a second end disposed in the opening in the outer tube, the plunger being movable in one direction through the rod opening in the stop housing for engaging a portion of a pen which engages the stop member and moves the stop member through the stop opening in the stop housing to a position wherein a portion of the stop member extends through the stop opening in the outer tube and a distance beyond the outer peripheral surface of the outer tube to position the stop assembly in the locking position, the plunger being movable in an opposite direction for permitting the stop member to be moved into the stop chamber to the unlocking position of the stop assembly;

a lock assembly having a locked position and an unlocked position;

a blocking assembly interposed between the first end of the plunger and the stop housing in the locked position of the lock assembly and being removable from between the first end of the plunger and stop housing in an unlocked position of the lock assembly, the first end of the plunger being engagable with a portion of the blocking assembly for removing the blocking assembly from between the first end of the plunger and stop housing and permitting the plunger to be moved in the direction toward the stop housing for engaging and moving the stop assembly to the unlocking position, a portion of the blocking assembly being interposed between the first end of the plunger and stop housing for preventing the plunger from being moved in the direction toward the stop housing in the locked position of the lock assembly, the blocking assembly comprising:

a blocking member interposed between the first end of the plunger and the stop assembly in a blocking position, the blocking member being movable to an unblocking position wherein the first end of the plunger is engagable with portion of the stop assembly; and wherein the a lock assembly comprising:

at least two lock tubes with each lock tube having a lock tube opening formed therethrough and each lock tube having a stop opening formed therethrough, each lock tube being disposed in the lock tube opening of one of the other lock tubes, and each lock tube being rotatable relative to the other lock tubes to one position wherein the stop openings in the lock tubes are aligned in the locked position of the lock assembly and each of the lock tubes being rotatable relative to the other lock tubes to other positions wherein the lock tube opening in at least one of the lock tubes is not aligned with its corresponding lock tube openings in the other lock tubes in the locked position of the lock assembly, the blocking member being disposed in the lock tube opening of one of the lock tubes and the plunger being disposed in the lock tube opening of one of the lock tubes with the blocking member being positioned in alignment with the lock tube openings in the lock tubes, the blocking member being movable through the lock tube openings in the lock tubes to the unblocking position in an aligned position of the lock tube openings in the lock tubes for permitting the first end of the plunger to be moved into engagement with the stop assembly for positioning the stop assembly in the unlocking position;

means for rotating the lock tubes to the one position wherein the lock tube openings in each of the lock tubes are aligned in an unlocked position of the lock assembly and for rotating the locked tubes to other positions wherein the lock tube openings in the lock tubes are not aligned in the locked position of the lock assembly.

30. The firearm safety device for preventing the discharge of a firearm wherein the firearm comprises a barrel having a barrel bore, the firearm safety device comprising:

a tube assembly having a first end and a second end and having an outer peripheral surface sized so that the first end of the tube assembly is insertable through the barrel bore;

a stop assembly connected to the tube assembly having a locking position and an unlocking position, a portion of the stop assembly extending a distance beyond the outer peripheral surface of the tube assembly in the locking position of the stop assembly;

a lock assembly connected to the tube assembly having a locked position and an unlocked position, comprising:

at least two lock tubes disposed in the tube assembly with each lock tube having a lock tube opening formed therethrough, the lock tubes being rotatable relative to each other to one position wherein the lock tube openings in the lock tube openings are aligned in the unlocked position of the lock assembly;

means for rotating each of the lock tubes to an unlocked position of the lock assembly wherein the lock tube openings in the lock tubes are aligned and for moving the lock tubes to a locked position of the lock assembly wherein at least one of the lock tube openings is not aligned with its corresponding lock tube openings;

means for engaging the stop assembly and moving the stop assembly to the unlocking position in the unlocked position of the lock assembly, said stop assembly being moved to the locking position when disengaged from said means, and said means being prevented from engaging the stop assembly and moving the stop assembly to the unlocking position in the locked position of the lock assembly, the tube assembly being insertable into the barrel bore in the unlocking position of the stop assembly and the unlocked position of the locked assembly and the portion of the stop assembly extending outwardly from the outer peripheral surface of the tube assembly in the locking position of the stop assembly engaging a portion of the firearm for preventing the removal of the tube assembly from the barrel bore of the barrel in the locking position of the stop assembly, comprising:

a plunger having a first end and a second end movably disposed in the tube assembly for movement in one direction toward the stop assembly and movable in an opposite direction away from the stop assembly; and a blocking assembly interposed between the first end of the plunger and the stop assembly in the locked position of the lock assembly and being removable from between the first end of the plunger and the stop assembly in an unlocked position of the lock assembly, the first end of the plunger being engagable with a portion of the blocking assembly for removing the blocking assembly from between the first end of the plunger and the stop assembly and permitting the plunger to be moved in the direction toward the stop assembly for engaging the stop assembly and moving the stop assembly to the unlocking position, a portion of the blocking assembly being interposed between the first end of the plunger and the stop assembly for preventing the plunger from being moved in the direction toward the stop assembly and engaging the stop assembly in the locked position of the lock assembly, the blocking assembly comprising:

a blocking member;

a block tube disposed in the lock tubes having a block tube opening formed therethrough and a block opening formed through a portion thereof, the lock tubes being rotatable to the one position wherein the lock tube openings in the lock tubes are aligned and the lock tube openings in the lock tubes are aligned with the block opening in the block tube in the unlocked position of the lock assembly, the blocking member being disposed in the block tube and being movable through the block opening and through at least a portion of the lock tube openings to the unlocking position in an aligned position of the lock tube openings with the block opening, the first end of the plunger being engagable with the blocking member for moving the blocking member through the block opening and through the lock tube openings to the unlocking position in the unlocked position of the lock assembly for permitting the first end of the plunger to move into engagement with the stop assembly.

31. A firearm safety device for preventing the discharge of a firearm wherein the firearm comprises a barrel with a barrel bore extending therethrough, comprising:

a tube assembly having a first end and a second end and having an outer peripheral surface sized so that the first end of the tube assembly is insertable through the barrel bore and wherein the tube assembly further comprises:

an outer tube having a first end and a second end, the first end of the outer tube forming to the first end of the tube assembly and the second end of the outer tube forming to the second end of the tube assembly, the outer tube having an outer peripheral surface forming to the outer peripheral surface of the tube assembly, the outer tube having an opening extending therethrough, the outer tube having a stop opening formed therethrough the outer peripheral surface thereof;

a stop assembly having a stop member, the stop assembly being connected to the tube assembly having a locking position and an unlocking position, a portion of the stop member extending a distance beyond the outer peripheral surface of the tube assembly in the locking position of the stop assembly and wherein the stop assembly further comprises:

a stop housing having a stop chamber formed in a portion thereof with a stop opening being formed through the stop housing in communication with the stop chamber, the stop chamber being positioned in the opening in the outer tube so that the stop opening in the stop housing is aligned with the stop opening in the outer tube;

the stop member disposed in the stop housing, at least a portion of the stop member being movable through the stop opening in the stop housing and through the stop opening in the outer tube and a portion of the stop member extending a distance beyond the outer peripheral surface of the outer tube in the locking position of the stop assembly and at least a portion of the stop member being disposed in the stop chamber with no portion of the stop member extending beyond the outer peripheral surface of the outer tube in the unlocking position of the stop assembly;

bias means for moving the stop member to the locking position;

a lock assembly connected to the tube assembly having a locked position and an unlocked position; and means for engaging the stop assembly and moving the stop assembly to the unlocking position in the unlocked position of the lock assembly, said stop assembly being moved to the locking position when disengaged from said means, and said means being prevented from engaging the stop assembly and moving the stop assembly to the unlocking position in the locked position of the lock assembly, the tube assembly being insertable into the barrel bore in the unlocking position of the stop assembly and the unlocked position of the lock assembly and the portion of the stop member extending outwardly from the outer peripheral surface of the tube assembly in the locking position of the stop assembly engaging a portion of the firearm for preventing the removal of the tube assembly from the barrel bore of the barrel in the locking position of the stop assembly and wherein said means for engaging the stop assembly and moving the stop assembly to the unlocking position is defined further as engaging the stop assembly and moving the stop assembly to the unlocking position against said bias means, said bias means automatically moving the stop member to the locking position when said means for engaging the stop assembly is disengaged from the stop assembly.

32. The firearm safety device of claim 31 wherein the stop housing further comprises a pin opening formed through a portion thereof in communication with the stop chamber, and wherein the bias means further comprises:

a pin having a portion extending through the pin opening and the stop housing and through the stop chamber, the pin having a portion engaging the stop member for moving the stop member to the locking position and having another portion for permitting the stop member to be moved to the unlocking position;

a spring disposed in the opening in the outer tube, a portion of the spring engaging the pin for moving the pin to a position wherein the portion of the pin adapted to engage the stop member and move the stop member to the locking position is disposed in the stop chamber and engages the stop member and moves the stop member to the locking position.

33. The firearm safety device of claim 32 wherein the stop member is defined further as being a spherically shaped member, and wherein the pin is defined further to comprise a pin head having an enlarged diameter portion connected thereto forming the portion of the pin engagable with the stop member for moving the stop member to the locking position and a reduced diameter portion connected to the enlarged diameter portion and comprising the portion of the pin permitting the stop member to be moved to the unlocking position.

34. The firearm safety device of claim 32 wherein the means for engaging the stop assembly further comprises:

a plunger having a first end and a second end, the plunger being disposed in the tube assembly with the first end of the plunger being disposed near and spaced a distance from the pin in the locked position of the lock assembly, a plunger cap being connected to the second end of the plunger, the plunger being movable in one direction toward the pin and movable in an opposite direction away from the pin, the first end of the plunger being engagable with a portion of the pin for moving the pin in a direction against the force of the spring engaging the pin for moving the pin to a position permitting the stop member to be moved to the unlocking position, the plunger being movable in the direction away from the pin for permitting the spring to move the pin back to the position for engaging the stop member and moving the stop member to the locking position.

35. The firearm safety device of claim 34 further comprising:

a blocking assembly interposed between the first end of the plunger and the pin in the locked position of the lock assembly and being removable from between the first end of the plunger and the pin in an unlocked position of the lock assembly, the first end of the plunger being engagable with a portion of the blocking assembly for removing the blocking assembly from between the first end of the plunger and the pin and permitting the plunger to be moved in the direction toward the pin for engaging the pin and moving the stop assembly to the unlocking position, a portion of the blocking assembly being interposed between the first end of the plunger and the pin for preventing the plunger from being moved in the direction toward the pin and engaging the pin in the locked position of the lock assembly.

36. The firearm safety device of claim 35 further comprising:

a plunger spring engagable with at least one of the plunger cap and the plunger for biasing the plunger cap and the plunger connected thereto in a direction moving the plunger in a direction away from the pin.

37. A firearm safety device for preventing the discharge of a firearm wherein the firearm comprises a barrel with a barrel bore extending therethrough, comprising:

a tube assembly having a first end and a second end and having an outer peripheral surface sized so that the first end of the tube assembly is insertable through the barrel bore and wherein the tube assembly further comprises:

an outer tube having a first end and a second end, the first end of the outer tube forming to the first end of the tube assembly and the second end of the outer tube forming to the second end of the tube assembly, the outer tube having an outer peripheral surface forming to the outer peripheral surface of the tube assembly, the outer tube having an opening extending therethrough, the outer tube having three stop openings formed therethrough the outer peripheral surface thereof;

a stop assembly connected to the tube assembly having a locking position and an unlocking position, a portion of the stop assembly extending a distance beyond the outer peripheral surface of the tube assembly in the locking position of the stop assembly and wherein the stop assembly further comprises:

a stop housing having a stop chamber formed in a portion thereof with three stop openings being formed through the stop housing in communication with the stop chamber, the stop chamber being positioned in the opening in the outer tube so that the stop openings in the stop housing are aligned with the stop openings in the outer tube;

three stop members disposed in the stop housing, at least a portion of each of the stop members being movable through one of the stop openings in the stop housing and through one of the stop openings in the outer tube extending a distance beyond the outer peripheral surface of one of the outer tubes in the locking position of the stop assembly and at least a portion of each of the stop members being disposed in the stop chamber with no portion of the stop members extending beyond the outer peripheral surface of one of the outer tubes in the unlocking position of the stop assembly;

bias means for moving the stop members to the locking position;

a lock assembly connected to the tube assembly having a locked position and an unlocked position; and means for engaging the stop assembly and moving the stop assembly to the unlocking position in the unlocked position of the lock assembly, said stop assembly being moved to the locking position when disengaged from said means, and said means being prevented from engaging the stop assembly and moving the stop assembly to the unlocking position in the locked position of the lock assembly, the tube assembly being insertable into the barrel bore in the unlocking position of the stop assembly and the unlocked position of the lock assembly and the portion of the stop assembly extending outwardly from the outer peripheral surface of the tube assembly in the locking position of the stop assembly engaging a portion of the firearm for preventing the removal of the tube assembly from the barrel bore of the barrel in the locking position of the stop assembly, and wherein said means is defined further as engaging the stop assembly and moving the stop assembly to the unlocking position against said bias means, said bias means automatically moving the stop members to the locking position when said means for engaging the stop assembly is disengaged from the stop assembly.

38. The firearm safety device of claim 37 wherein the stop housing further comprises a pin opening formed through a portion thereof in communication with the stop chamber, and wherein the bias means further comprises:

a pin having a portion extending through the pin opening and the stop housing and through the stop chamber, the pin having a portion engaging each of the stop members for moving each of the stop members to the locking position and having another portion for permitting each of the stop members to be moved to the unlocking position;

a spring disposed in the opening in the outer tube, a portion of the spring engaging the pin for moving the pin to a position wherein the portion of the pin adapted to engage each of the stop members and move each of the stop members to the locking position is disposed in the stop chamber and engages each of the stop members and moves each of the stop members to the locking position.

39. The firearm safety device of claim 38 wherein the stop members are defined further as being spherically shaped members, and wherein the pin is defined further to comprise a pin head having an enlarged diameter portion connected thereto forming the portion of the pin engagable with the stop members for moving the stop members to the locking position and a reduced diameter portion connected to the enlarged diameter portion and comprising the portion of the pin permitting the stop members to be moved to the unlocking position.

40. The firearm safety device of claim 38 wherein the means for engaging the stop assembly further comprises:

a plunger having a first end and a second end, the plunger being disposed in the opening in the outer tube with the first end of the plunger being disposed near and spaced a distance from the pin in the locked position of the lock assembly, a plunger cap being connected to the second end of the plunger, the plunger being movable in one direction toward the pin and movable in an opposite direction away from the pin, the first end of the plunger being engagable with a portion of the pin for moving the pin in a direction against the force of the spring engaging the pin for moving the pin to a position permitting the stop members to be moved to the unlocking position, the plunger being movable in the direction away from the pin for permitting the spring to move the pin back to the position for engaging the stop members and moving the stop members to the locking position.

41. The firearm safety device of claim 40 further comprising:

a blocking assembly interposed between the first end of the plunger and the pin in the locked position of the lock assembly and being removable from between the first end of the plunger and the pin in an unlocked position of the lock assembly, the first end of the pin being engagable with a portion of the blocking assembly for removing the blocking assembly from between the first end of the plunger and the pin and permitting the plunger to be moved in the direction toward the pin for engaging the pin and moving the stop assembly to the unlocking position, a portion of the blocking assembly being interposed between the first end of the plunger and the pin for preventing the plunger from being moved in the direction toward the pin and engaging the pin in the locked position of the lock assembly.

42. A firearm safety device for preventing the discharge of a firearm wherein the firearm comprises a barrel with a barrel bore extending therethrough, comprising:

a tube assembly having a first end and a second end and having an outer peripheral surface sized so that the first end of the tube assembly is insertable through the barrel bore;

a stop assembly connected to the tube assembly having a locking position and an unlocking position, a portion of the stop assembly extending a distance beyond the outer peripheral surface of the tube assembly in the locking position of the stop assembly;

a lock assembly connected to the tube assembly having a locked position and an unlocked position;

means for engaging the stop assembly and moving the stop assembly to the unlocking position in the unlocked position of the lock assembly, said stop assembly being moved to the locking position when disengaged from said means, and said means being prevented from engaging the stop assembly and moving the stop assembly to the unlocking position in the locked position of the lock assembly, the tube assembly being insertable into the barrel bore in the unlocking position of the stop assembly and the unlocked position of the lock assembly and the portion of the stop assembly extending outwardly from the outer peripheral surface of the tube assembly in the locking position of the stop assembly engaging a portion of the firearm for preventing the removal of the tube assembly from the barrel bore of the barrel in the locking position of the stop assembly and wherein the said means further comprises:

a plunger having a first end and a second end movably disposed in the tube assembly for movement in one direction toward the stop assembly and movable in an opposite direction away from the stop assembly;

a blocking assembly which comprises:

a blocking member disposed in the tube assembly interposed between the first end of the plunger and the stop assembly for blocking the plunger from moving toward and into engagement with the stop assembly in a blocking position of the blocking assembly, and wherein the lock assembly is further defined as holding the blocking assembly in the blocking position in the locked position of the lock assembly, and permitting the blocking assembly to be moved to the unblocking position in the unlocked position of the lock assembly.

43. The firearm safety device of claim 42 wherein the lock assembly further comprises:

at least two lock tubes with each lock tube having a lock tube opening formed therethrough, the lock tubes being rotatable relative to each other to one position wherein the lock tube openings in the lock tubes are aligned in the unlocked position of the lock assembly, the blocking member being disposed in the lock tubes and being movable through the lock tube openings to the unblocking position in an aligned position of the lock tube openings, the first end of the plunger being engagable with the blocking member for moving the blocking member through the lock tube openings in the lock tubes to the unblocking position in the unlocked position of the lock assembly for permitting the first end of the plunger to move into an engagement with the stop assembly; and means for rotating each of the lock tubes to an unlocked position of the lock assembly wherein the lock tube openings in the lock tubes are aligned and for moving the lock tubes to a locked position of the lock assembly wherein at least one of the lock tube openings is not aligned with its corresponding lock tube openings.

44. The firearm safety device of claim 43 further comprising:

a block tube disposed in the lock tubes having a block tube opening formed therethrough and a block opening formed through a portion thereof, the blocking member being disposed in the block tube opening and the lock tube openings in the lock tubes being rotatable to a position aligned with the block opening in the block tube in the unlocked position of the lock assembly.

* * * * *

UNITED STATES PATENT AND TRADEMARK OFFICE

CERTIFICATE OF CORRECTION

PATENT NO. : 5,398,438

DATED : March 21, 1995

INVENTOR(S) : Williams

Figure 14:
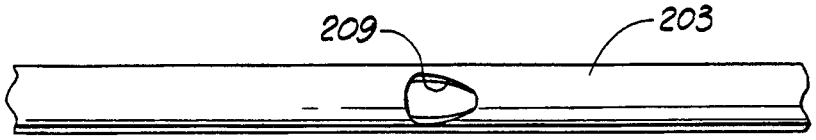
FIG. 14 is a top elevational view of the block tube portion of the blocking assembly.

It is certified that error appears in the above-identified patent and that said Letters Patent is hereby corrected as shown below:

In the drawings, please add the reference numeral --201-- to Figure 14 as indicated below.

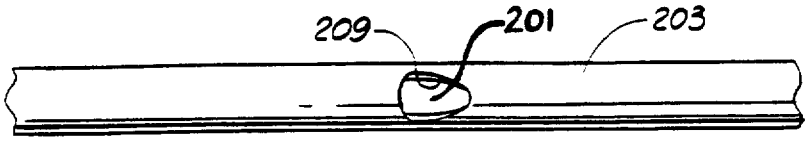

FIG. 14

UNITED STATES PATENT AND TRADEMARK OFFICE

CERTIFICATE OF CORRECTION

PATENT NO. : 5,398,438

DATED : March 21, 1995

INVENTOR(S) : Williams

It is certified that error appears in the above-identified patent and that said Letters Patent is hereby corrected as shown below:

In the drawings, please add the reference numeral --22-- to Figure 15 as indicated below.

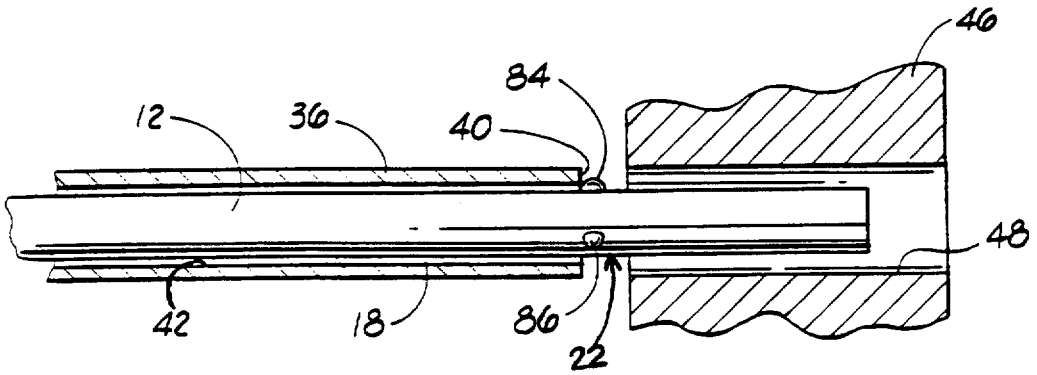

FIG. 15

UNITED STATES PATENT AND TRADEMARK OFFICE

CERTIFICATE OF CORRECTION

PATENT NO. : 5,398,438

DATED : March 21, 1995

INVENTOR(S) : Williams

It is certified that error appears in the above-identified patent and that said Letters Patent is hereby corrected as shown below:

Cover page, ABSTRACT, line 2, after "and/or" please delete "and".

Column 1, line 39, after "sectional" please delete "view".

Column 2, line 68, please delete "bore diameter 42" and substitute therefor -- bore diameter 44 --.

Column 4, line 61, please delete "(FIG. 7)" and substitute therefor -- (FIGS. 3 and 7) --.

Column 5, line 38, please delete "reduced diameter position 96" and substitute therefor -- reduced diameter portion 96 --.

Column 6, line 44, please delete "second end" and substitute therefor -- second ends --.

Column 6, line 67, please delete "opening 152" and substitute therefor -- opening 154 --.

Column 7, line 36, please delete "second lock tube 126" and substitute therefor -- second lock tube 114 --.

Column 7, line 64, after "thumb wheel 164" please insert -- is --.

Column 8, line 1, please delete "extending" and substitute therefor -- extends --.

UNITED STATES PATENT AND TRADEMARK OFFICE

CERTIFICATE OF CORRECTION

PATENT NO. : 5,398,438

DATED : March 21, 1995

INVENTOR(S) : Williams

It is certified that error appears in the above-identified patent and that said Letters Patent is hereby corrected as shown below:

Column 8, line 4, please delete "handle grip" and substitute therefor -- hand grip --.

Column 8, line 7, please delete "bulkhead" and substitute therefor -- bulkheads --.

Column 8, lines 55-56, please delete "locking assembly" and substitute therefor -- blocking assembly --.

Column 9, line 11, please delete "locking assembly" and substitute therefor -- blocking assembly --.

Column 9, line 42, please delete "3214" and substitute therefor -- 3217 --.

Column 9, line 58, please delete "FIGS. 1 and 5" and substitute therefor -- FIG. 5 --.

Column 9, line 64, please delete "plunger 30" and substitute therefor -- plunger 28 --.

Column 10, line 1, please delete "locked tube opening" and substitute therefor -- lock tube opening --.

Column 10, line 3, please delete "plunger 128" and substitute therefor -- plunger 28 --.

UNITED STATES PATENT AND TRADEMARK OFFICE

CERTIFICATE OF CORRECTION

PATENT NO. : 5,398,438

DATED : March 21, 1995

INVENTOR(S) : Williams

It is certified that error appears in the above-identified patent and that said Letters Patent is hereby corrected as shown below:

Column 10, line 11, please delete "locked assembly" and substitute therefor -- lock assembly --.

Column 10, line 20, please delete "lock" and substitute therefor -- locked --.

Column 10, line 22, please delete "barrel bore 92" and substitute therefor -- barrel bore 42 --.

Column 10, line 27, please delete "safety device 12" and substitute therefor -- safety device 10 --.

Column 10, line 51, please delete "angled lock opening" and substitute therefor -- angled block opening --.

Column 11, line 49, please delete "blocking member 108" and substitute therefor -- blocking member 200 --.

Column 11, lines 50-51, please delete "enlarged diameter portion 96" and substitute therefor -- enlarged diameter portion 94 --.

Column 11, line 52, please delete "enlarged diameter portion 96" and substitute therefor -- enlarged diameter portion 94 --.

UNITED STATES PATENT AND TRADEMARK OFFICE

CERTIFICATE OF CORRECTION

PATENT NO. : 5,398,438

DATED : March 21, 1995

INVENTOR(S) : Williams

It is certified that error appears in the above-identified patent and that said Letters Patent is hereby corrected as shown below:

Column 12, line 25, please delete "lock tubes" and substitute therefor -- lock openings --.

Column 12, lines 35-36, please delete "lock assembly 24" and substitute therefor -- lock assembly 34 --.

Column 12, line 37, please delete "lock assembly 24" and substitute therefor -- lock assembly 34 --.

Column 12, line 49, please delete "align" and substitute therefor -- aligned --.

Column 13, line 6, please delete "third locked tube" and substitute therefor -- third lock tube--.

Column 13, line 42, after "between" please insert -- the --.

Column 19, line 41, please delete "plunger" and substitute therefor -- rod --.

Column 23, line 32, please delete "pen" and substitute therefor -- pin --.

Column 23, line 67, after "with" please insert -- a --.

UNITED STATES PATENT AND TRADEMARK OFFICE

CERTIFICATE OF CORRECTION

PATENT NO. : 5,398,438

DATED : March 21, 1995

INVENTOR(S) : Williams

It is certified that error appears in the above-identified patent and that said Letters Patent is hereby corrected as shown below:

Column 24, line 1, please delete "wherein the".

Column 24, lines 57-58, please delete "tube openings" and substitute therefor -- tubes --.

Signed and Sealed this

Fourteenth Day of November, 1995

Bruce Lehman

*Attest:*

BRUCE LEHMAN

*Attesting Officer*

*Commissioner of Patents and Trademarks*